US007669966B2

(12) United States Patent
Shimura et al.

(10) Patent No.: US 7,669,966 B2
(45) Date of Patent: Mar. 2, 2010

(54) LIQUID DROPLET DISCHARGING APPARATUS AND HEAD WITH LIQUID DROPLET GUIDES

(75) Inventors: Yasuto Shimura, Suwa (JP); Takahiro Usui, Shiojiri (JP); Shinri Sakai, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 431 days.

(21) Appl. No.: 11/677,841

(22) Filed: Feb. 22, 2007

(65) Prior Publication Data

US 2007/0216726 A1 Sep. 20, 2007

(30) Foreign Application Priority Data

Mar. 14, 2006 (JP) ..... 2006-068830
Mar. 15, 2006 (JP) ..... 2006-070682
Sep. 27, 2006 (JP) ..... 2006-262308

(51) Int. Cl.
*B41J 2/14* (2006.01)
*B41J 2/16* (2006.01)

(52) U.S. Cl. ..... 347/47; 347/68

(58) Field of Classification Search ..... 347/20, 347/44, 47, 68, 70–72
See application file for complete search history.

(56) References Cited

U.S. PATENT DOCUMENTS 6,634,734 B1 10/2003 Koide et al.
6,749,283 B2 * 6/2004 Sanada ..... 347/47
2005/0110835 A1 5/2005 Ito et al.
2008/0000086 A1 1/2008 Ito et al.

FOREIGN PATENT DOCUMENTS

JP A 05-193144 8/1993
JP A 07-290701 11/1995
JP A 2001-310468 11/2001
JP A 2002-011880 1/2002
JP A 2002-052718 2/2002
JP A 2002-192716 7/2002
JP A 2004-314524 11/2004
JP A 2005-103984 4/2005

* cited by examiner

*Primary Examiner*—Juanita D Stephens
(74) *Attorney, Agent, or Firm*—Oliff & Berridge, PLC

(57) ABSTRACT

A liquid droplet discharging head includes: a substrate; a pressure chamber connected to the substrate; a penetrating portion formed in the substrate to discharge a liquid droplet; and a plurality of liquid droplet guiding portions formed at the penetrating portion of the substrate to guide the liquid droplet, in which each of the liquid droplet guiding portions extends with a curvature in an discharging direction of the liquid droplet.

18 Claims, 15 Drawing Sheets

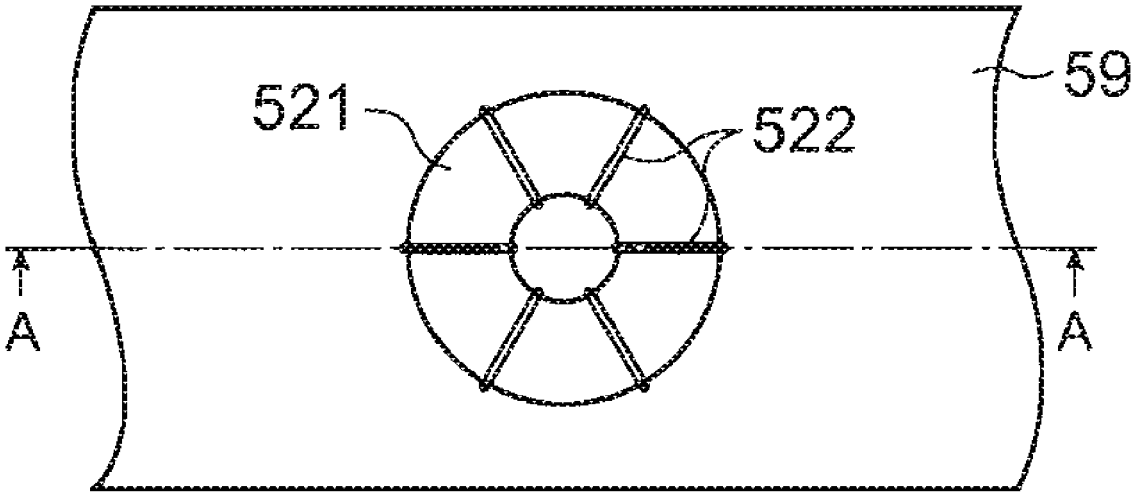
FIG.14A
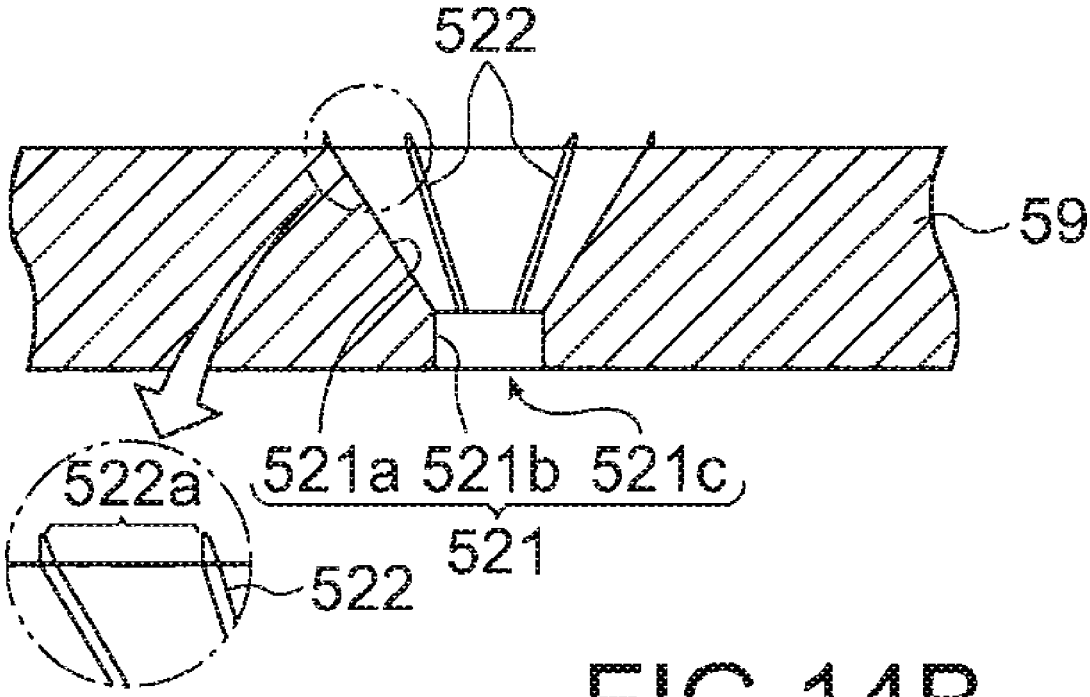
FIG.14B
FIG.14C

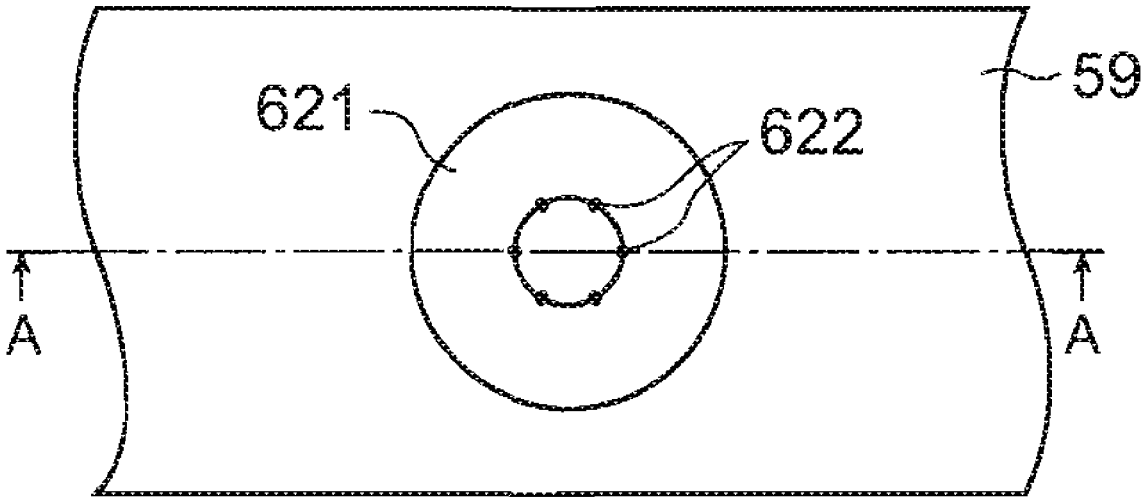
FIG.15A
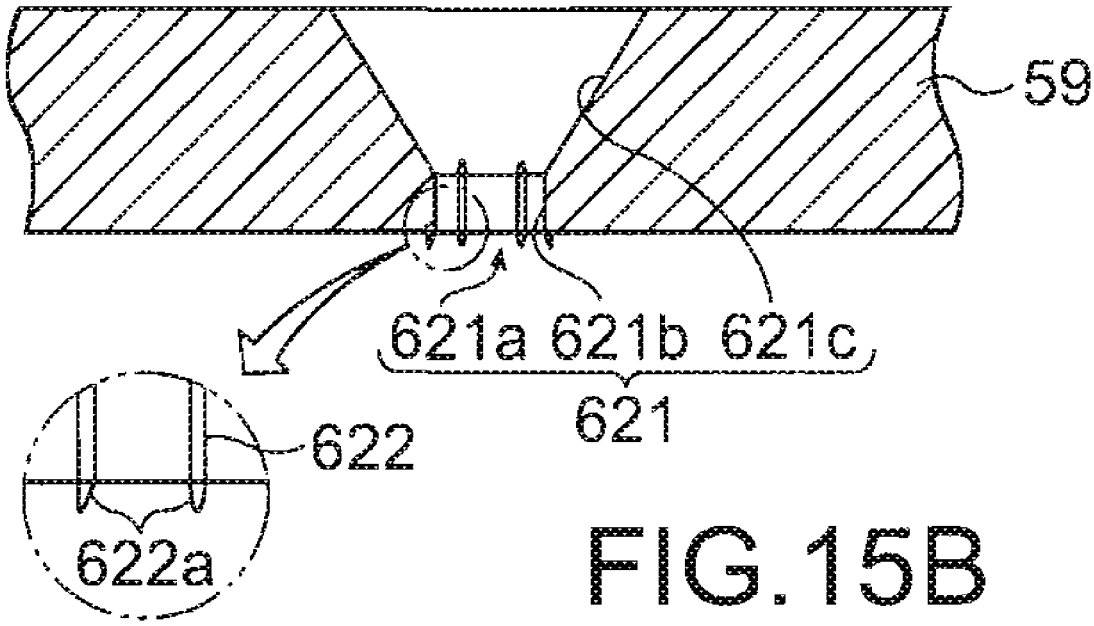
FIG.15B
FIG.15C

LIQUID DROPLET DISCHARGING APPARATUS AND HEAD WITH LIQUID DROPLET GUIDES

BACKGROUND

1. Technical Field

Several aspects of the present invention relate to a liquid droplet discharging head, a method for manufacturing the same, a liquid droplet discharging apparatus and a method for manufacturing the same.

2. Related Art

Related art discloses that a method for drawing a minute pattern such as a metal wiring by using a liquid droplet discharging technique such as an inkjet printer or the like and an application example of the technique.

For example, JP-A-05-193144 provides a structure of a liquid droplet discharging head. In the structure thereof, a nozzle section is formed so as to have a conical shape on an discharging side of the liquid droplet discharging head. This improves a stability of straight flight of a liquid droplet and reduces a variation in the amount of a liquid droplet discharged from each nozzle. In addition, there is provided a method for manufacturing the nozzle section of the liquid droplet discharging head. The method includes a process of laminating a photosensitive resin on a flow passage side of a nozzle plate having a nozzle hole diameter and performing light exposure from a side opposite to the flow passage side to make the nozzle section conical.

JP-A-05-193144 is an example of related art.

In the liquid droplet discharging head disclosed in the above example, however, along with further miniaturization of liquid droplets, the straight flight stability thereof has not been sufficiently maintained due to air resistance. Accordingly, it has been difficult to allow liquid droplets to accurately land on target positions thereof. Drawing more minute patterns directly by a liquid droplet discharging technique requires more minute liquid droplets. On the other hand, further miniaturization thereof hinders their accurate landing on target positions. Additionally, in manufacturing a nozzle plate with tiny nozzles densely arranged to discharge miniaturized liquid droplets, nozzle directions tend to divert. As a result, a subtle diversion in the nozzle directions has caused a failure in the accurate landing of liquid droplets on target positions. Therefore, the above problem has hindered the production of high-quality drawings.

SUMMARY

An advantage of the present invention is to provide a liquid droplet discharging head that allows production of high-quality drawings even with highly miniaturized liquid droplets, a manufacturing method thereof, a liquid droplet discharging apparatus and a manufacturing method thereof. Another advantage of the invention is to allow production of high-quality drawings regardless of subtle diversions in a direction of a nozzle.

A liquid droplet discharging head according to a first aspect of the invention includes a substrate, a pressure chamber connected to the substrate, a penetrating portion formed in the substrate to discharge a liquid droplet and a plurality of liquid droplet guiding portions formed at the penetrating portion of the substrate to guide the liquid droplet, in which each of the liquid droplet guiding portions extends with a curvature in an discharging direction of the liquid droplet.

In the liquid droplet discharging head according to the first aspect, the liquid droplet guiding portions are formed at the penetrating portion and extend with the curvature in the discharging direction of the liquid droplet. This makes it easier to apply a rotational force to the liquid droplet, so that the liquid droplet can easily be focused to a center of the penetrating portion. Then, the liquid droplet discharged from the penetrating portion is hardly influenced by air resistance and will fly straight in an air. Consequently, the structure facilitates the liquid droplet to land on a target position accurately. Therefore, the liquid droplet discharging head allows improvement in landing position accuracy of liquid droplets.

In addition, preferably, the liquid droplet discharging head according to the first aspect further includes a plurality of pointed end portions provided on a surface of the penetrating portion in a direction intersecting with the discharging direction of the liquid droplet, the pointed end portions being included in the liquid droplet guiding portions.

In this manner, the plurality of pointed end portions are formed at the liquid droplet guiding portions on the surface of the penetrating portion and are positioned in the direction intersecting with the discharging direction of the liquid droplet. An intersection of the liquid droplet with each of the pointed end portions makes it easier to apply a rotational force to the liquid droplet. This makes it easier for the liquid droplet to be focused to the center of the penetrating portion. Accordingly, the liquid droplet discharged from the penetrating portion will fly straight in the air, thereby landing on the target position accurately. Therefore, the liquid droplet discharging head allows improvement in the landing position accuracy.

In addition, preferably, in the liquid droplet discharging head according to the first aspect, a surface wettability with respect to the liquid droplet is different between the liquid droplet guiding portions and a region other than the guiding portions on the penetrating portion.

In this manner, the liquid droplet guiding portions are formed so as to have a surface wettability different from that of the remaining region. Accordingly, the penetrating portion has both lyophilic and lyophobic regions. This makes it easier to apply a rotational force to the liquid droplet, so that the liquid droplet is easily focused to the center of the penetrating portion. Consequently, the liquid droplet discharged from the penetrating portion will fly straight in the air, which facilitates an accurate landing thereof on a target position. Therefore, the liquid droplet discharging head allows improvement in the landing position accuracy.

A liquid droplet discharging head according to a second aspect of the invention includes a substrate, a pressure chamber connected to the substrate, a penetrating portion formed in the substrate to discharge a liquid droplet and including a first penetrating portion that is formed so as to be connected to the pressure chamber and a second penetrating portion that communicates with the first penetrating portion and a plurality of pointed end portions formed on a surface of at least one of the first and second penetrating portions in a direction intersecting with an discharging direction of the liquid droplet, each of the pointed end portions including a first line and a second line connected to the first line, and being included in each of the liquid droplet guiding portions extending with a curvature in an discharging direction of the liquid droplet.

In the liquid droplet discharging head according to the second aspect, the liquid droplet guiding portions having the plurality of pointed end portions including the first and second lines are formed on the surface of at least one of the first and second penetrating portions. Additionally, the liquid droplet guiding portions having the pointed end portions extend with the curvature in the discharging direction of the liquid droplet. The structure makes it easier to apply a rotational force to the liquid droplet and then facilitates the liquid droplet to be focused to the center of the penetrating portion. Accordingly, the liquid droplet discharged from the penetrating portion will fly relatively straight in the air, so that the liquid droplet can land on a target position thereof more accurately. Therefore, the liquid droplet discharging head allows improvement in the landing position accuracy.

In addition, preferably, in the above liquid droplet discharging head, at least one of the first and second lines is formed so as to include a round portion.

In this manner, when the liquid droplet is discharged while being rotated in a rotational direction, including the round portion in at least one of the lines facilitates the liquid droplet to rotate in a given rotational direction. Thus, a directivity of the liquid droplet can be increased. Therefore, the liquid droplet discharging head allows a highly accurate landing thereof on the target position.

In addition, preferably, in the liquid droplet discharging head according to the second aspect, the first line is longer than the second line.

In this manner, since the first line is made longer than the second line, a direction of each of the pointed end portions can be deviated in a particular direction. This can thus increase the directivity of the liquid droplet in a particular direction. Therefore, the liquid droplet discharging head can provide a high accuracy in the landing position of the liquid droplet.

In addition, in the liquid droplet discharging head according to the second aspect, preferably, the first and second lines are positioned at an approximately equal distance from the pointed end portion.

In this manner, the first and second lines are spaced apart approximately equally from the pointed end portion. This makes it easier to align the directions of the plurality of pointed end portions in a particular direction. Accordingly, the arrangement can increase the directivity of the liquid droplet in a particular rotational direction. Therefore, the liquid droplet discharging head can provide a high accuracy in the landing position.

In addition, in the liquid droplet discharging head according to the second aspect, preferably, the first and second lines are positioned symmetrically with respect to the pointed end portion.

In this manner, due to the symmetrical positioning of the first and second lines with respect to the pointed end portion, an amount of friction resistance applied to the liquid droplet can approximately be equalized. This can reduce a variation in the discharging direction of the liquid droplet occurring when discharged from the liquid droplet discharging head. Therefore, the liquid droplet discharging head can provide a high accuracy in the landing position.

A liquid droplet discharging apparatus according to a third aspect of the invention includes the liquid droplet discharging head according to one of the first and second aspects described above.

According to the third aspect, the liquid droplet discharging apparatus includes the liquid droplet discharging head that can provide a high accuracy in the landing position of liquid droplets, as described above. Therefore, the discharging apparatus can produce high-quality drawings.

A method for manufacturing a liquid droplet discharging head according to a fourth aspect of the invention includes connecting a substrate to a pressure chamber, forming a penetrating portion in the substrate to discharge a liquid droplet, and forming a plurality of liquid droplet guiding portions formed at the penetrating portion of the substrate and extending with a curvature in an discharging direction of the liquid droplet.

In this method, the liquid droplet guiding portions are formed at the penetrating portion and extend with a curvature in the liquid-droplet discharging direction. The arrangement facilitates an application of a rotational force to the liquid droplet, as well as makes it easier for the liquid droplet to be focused to the center of the penetrating portion. Then, the liquid droplet discharged from the penetrating portion is hardly influenced by air resistance, thereby flying straight in the air. Consequently, the liquid droplet can land on a target position more easily and accurately. Therefore, the liquid droplet discharging head allows improvement in the landing position accuracy.

In the manufacturing method thereof according to the fourth aspect, forming the liquid droplet guiding portions preferably include forming a plurality of pointed end portions on a surface of the penetrating portion in a direction intersecting with the discharging direction of the liquid droplet.

In this method, the plurality of pointed end portions are formed at the liquid droplet guiding portions on the surface of the penetrating portion and are positioned in the direction intersecting with the discharging direction of the liquid droplet. Thus, since a liquid droplet intersects with each of the pointed end portions, a rotational force can easily be applied to the liquid droplet. Accordingly, the liquid droplet is more easily focused to the center of the penetrating portion. Then, the liquid droplet discharged from the penetrating portion will fly straight in the air. Consequently, the liquid droplet can easily land on a target position thereof. Therefore, the method can provide a liquid droplet discharging head that allows improvement in the landing position accuracy of liquid droplets.

In the manufacturing method according to the fourth aspect, preferably, forming the liquid droplet guiding portions includes forming the liquid droplet guiding portions whose surface wettability with respect to the liquid droplet is different from a surface wettability of the penetrating portion.

In this method, since the liquid droplet guiding portions are formed so as to have a surface wettability different from that of the penetrating portion, both lyophilic and lyophobic regions are formed in the penetrating portion. This arrangement makes it easier to apply a rotational force to a liquid droplet. Then, the liquid droplet can more easily be focused to the center of the penetrating portion, so that the liquid droplet discharged form the penetrating portion will fly straight in the air. Accordingly, it results in an accurate landing thereof on a target position. Therefore, the method can provide the liquid droplet discharging head that allows improvement in the landing position accuracy.

A method for manufacturing a liquid droplet discharging head according to a fifth aspect includes connecting a substrate to a pressure chamber to discharge a liquid droplet, forming a penetrating portion in the substrate, the penetrating portion having a first penetrating portion connected to the pressure chamber and a second penetrating portion communicating with the first penetrating portion and forming a liquid droplet guiding portion on a surface of at least one of the first and second penetrating portions, the guiding portion including each of a plurality of pointed end portions that has a first line and a second line connected to the first line, and extending with a curvature in an discharging direction of the liquid droplet.

In this method, the liquid droplet guiding portions that include the pointed end portions having the first and second lines are formed on the surface of at least one of the first and second penetrating portions and extend with a curvature in the discharging direction of the liquid droplet. This makes it easier to apply a rotational force to the liquid droplet, which facilitates the liquid droplet to be focused to the cent a plurality of pointed end portions that includes a first line and a second line connected to the first line of the penetrating portion. Accordingly, the liquid droplet discharged from the penetrating portion will fly relatively straight in the air, which facilitates an accurate landing thereof on a target position. Therefore, the method can manufacture a liquid droplet discharging head that allows further improvement in the landing position accuracy.

In the manufacturing method according to the fifth aspect, preferably, the liquid droplet guiding portion is formed such that at least one of the first and second lines has a round portion.

In this method, at least one of the first and second lines is formed so as to have the round portion. When the liquid droplet is discharged while being rotated in a rotational direction, the round portion makes it easier to rotate the liquid droplet in a particular rotational direction. Thus, the directivity of the liquid droplet can be increased. Therefore, the method can provide a liquid droplet discharging head that can show a high accuracy in the landing position of the liquid droplet.

In the manufacturing method according to the fifth aspect, preferably, the liquid droplet guiding portion is formed such that the first line is longer than the second line.

In this method, forming the first line longer than the second line facilitates the directions of the pointed end portions to deviate in a particular direction. This can increase the directivity of the liquid droplet in a particular rotational direction. Therefore, the method can provide a liquid droplet discharging head that can exhibit a high accuracy in the landing position.

In the manufacturing method according to the fifth aspect, preferably, the liquid droplet guiding portion is formed such that the first and second lines are positioned at an approximately equal distance from the pointed end portion.

In this method, positioning the first and second lines at an approximately equal distance from each of the pointed end portion allows the directions of the plurality of pointed end portions to be easily aligned in a particular direction. This can increase the directivity of the liquid droplet in the particular rotational direction. Therefore, the method can provide a liquid droplet discharging head that can show a high accuracy in the landing position.

In the manufacturing method according to the fifth aspect, preferably, the liquid droplet guiding portion is formed such that the first and second lines are positioned symmetrically with respect to the pointed end portion.

In this method, arranging the first and second lines symmetrically to the pointed end portion allows a friction resistance applied to the liquid droplet to be approximately equalized. This can reduce a variation in the discharging direction of the liquid droplet occurring when discharged from the liquid droplet discharging head. Therefore, the method can provide a liquid droplet discharging head that can exhibit a high accuracy in the landing position.

A method for manufacturing a liquid droplet discharging apparatus according to a sixth aspect of the invention is the manufacturing method of a liquid droplet discharging apparatus including the liquid droplet discharging head manufactured by the method according to the fourth aspect.

According to the sixth aspect, the discharging apparatus includes the liquid droplet discharging head that allows improvement in the landing position accuracy. Therefore, the method can provide the discharging apparatus that can produce improved high-quality drawings.

A liquid droplet discharging head according to a seventh aspect of the invention includes a substrate, a pressure chamber connected thereto, a penetrating portion formed in the substrate to discharge a liquid droplet and a plurality of liquid droplet guiding portions formed at the penetrating portion of the substrate to guide the liquid droplet and extending loosely and densely in an discharging direction of the liquid droplet.

In the liquid droplet discharging head above, the liquid droplet guiding portions are formed at the penetrating portion of the substrate and loosely and densely extend in the discharging direction of the liquid droplet. This arrangement allows subtle control in the discharging direction thereof. Even if a direction of the penetrating portion varies, a variation in the discharging direction thereof can be suppressed. That makes it easier for the liquid droplet to land on a target position accurately. Therefore, a liquid droplet discharging head can be provided that improves the landing position accuracy.

In the liquid droplet discharging head according to the seventh aspect, preferably, the liquid droplet guiding portions are formed in one of parallel and inclined manners with respect to the discharging direction of the liquid droplet and include grooves that are loosely and densely distributed.

In this liquid droplet discharging head, the grooves as the liquid droplet guiding portions are formed so as to be loosely and densely distributed in parallel with or at an inclination with respect to the discharging direction of the liquid droplet. The above formation applies a resistance to an discharged liquid droplet in a particular direction thus facilitating the liquid droplet having a subtle inclination to be emitted from the penetrating portion. Even if a direction of the penetrating portion varies, a flying direction of the liquid droplet can be controlled by correcting the discharging direction thereof in accordance with the direction of the penetrating portion. As a result, even a miniaturized liquid droplet can easily and accurately land on a target position thereof. Therefore, a liquid droplet discharging head can be provided that allows improvement in the landing position accuracy.

Furthermore, in the liquid droplet discharging head according to the seventh aspect, preferably, the liquid droplet guiding portions are formed in one of parallel and inclined manners with respect to the discharging direction of the liquid droplet and include patterns that are loosely and densely distributed having different wettabilities.

In this liquid droplet discharging head, the patterns having different wettabilities are loosely and densely distributed in parallel with or at an inclination with respect to the discharging direction of the liquid droplet. The arrangement applies a resistance to an discharged liquid droplet in a particular direction. Thus, it facilitates the liquid droplet having a subtle inclination to be emitted from the penetrating portion. Even if the direction of the penetrating portion varies, the flying direction of the liquid droplet can be adjusted by correcting the discharging direction thereof in accordance with the direction of the penetrating portion. As a result, even miniaturized liquid droplets can easily and accurately land on target positions thereof. Therefore, a liquid droplet discharging head can be provided that allows improvement in the landing position accuracy.

Still furthermore, in the liquid droplet discharging head according to the seventh aspect, preferably, the liquid droplet guiding portions are formed in one of parallel and inclined manners with respect to the discharging direction of the liquid droplet and include a plurality of minute recessed and protruded portions that are loosely and densely distributed.

As shown above, the liquid droplet discharging head includes the plurality of minute recessed and protruded portions that are loosely and densely distributed in parallel with or at an inclination with respect to the discharging direction of the liquid droplet. The arrangement applies a resistance to an discharged liquid droplet in a particular direction, and facilitates the liquid droplet having a subtle inclination to be emitted from the penetrating portion. Even if the direction of the penetrating portion varies, the flying direction of the liquid droplet can be adjusted by correcting the discharging direction thereof in accordance with the direction of the penetrating portion. As a result, that makes it easier for even a miniaturized liquid droplet to land on a target position thereof accurately. Therefore, a liquid droplet discharging head can be provided that allows improvement in the landing position accuracy.

In the liquid droplet discharging head according to the seventh aspect, preferably, the penetrating portion include a first penetrating portion connected to the pressure chamber and a second penetrating portion communicating with the first penetrating portion, in which the liquid droplet guiding portions are formed at the first penetrating portion.

In this liquid droplet discharging head, since the first penetrating portion has a conical shape, forming the liquid droplet guiding portions on the first penetrating portion facilitates guiding of the liquid droplets.

A liquid droplet discharging apparatus according to an eighth aspect includes the liquid droplet discharging head according to the seventh aspect.

The discharging apparatus according to the eighth aspect includes the liquid droplet discharging head that can show a high accuracy in the landing position, as described above. Therefore, the discharging apparatus can produce high-quality drawings.

A method for manufacturing a liquid droplet discharging head according to a ninth aspect includes connecting a substrate to a pressure chamber, forming a penetrating portion in the substrate to discharge a liquid droplet and forming a plurality of liquid droplet guiding portions formed at the penetrating portion and extending loosely and densely in an discharging direction of the liquid droplet.

In this method, the liquid droplet guiding portions are formed at the penetrating portion and loosely and densely extend in the discharging direction of the liquid droplet. The arrangement allows a subtle control in the discharging direction thereof. Even if the direction of the penetrating portion varies, a variation in the direction of a liquid droplet discharged from the penetrating portion can be suppressed. This makes it easier for the liquid droplet to land on a target position thereof accurately. Therefore, the method allows a manufacturing of the liquid droplet discharging head that allows improvement in the landing position accuracy.

In the manufacturing method according to the ninth aspect, preferably, forming the liquid droplet guiding portion includes forming a plurality of grooves that are loosely and densely distributed in one of parallel and inclined manners with respect to the discharging direction of the liquid droplet on a surface of the penetrating portion.

In this method, the grooves as the liquid droplet guiding portions are loosely and densely distributed in parallel or at an inclination with respect to the discharging direction of the liquid droplet. This arrangement applies a resistance to an discharged liquid droplet in a particular direction. This facilitates the liquid droplet having a subtle inclination to be emitted from the penetrating portion. Even if there is a variation in the direction of the penetrating portion, the flying direction of the liquid droplet can be adjusted by correcting the discharging direction thereof in accordance with the direction of the penetrating portion. Consequently, this makes it easier for even a miniaturized liquid droplet to land on a target position thereof accurately. Therefore, the method can provide the liquid droplet discharging head that allows improvement in the landing position accuracy.

In the manufacturing method according to the ninth aspect, preferably, forming the liquid droplet guiding portions includes forming a plurality of patterns having different wettabilities so as to be loosely and densely distributed in one of parallel and inclined manners with respect to the discharging direction of the liquid droplet on the surface of the penetrating portion.

In this method, the patterns with different wettabilities are loosely and densely distributed in parallel or at an inclination with respect to the discharging direction of the liquid droplet. The arrangement applies a resistance to an discharged liquid droplet in a particular direction. This facilitates the liquid droplet having a sublet inclination to be emitted from the penetrating portion. Even if there is a variation in the direction of the penetrating portion, the flying direction of the liquid droplet can be adjusted by correcting the discharging direction thereof in accordance with the direction of the penetrating portion. As a result, that makes it easier for even a miniaturized liquid droplet to land on a target position thereof accurately. Therefore, the method can provide the liquid droplet discharging head that allows improvement in the landing position accuracy.

In the manufacturing method according to the ninth aspect, preferably, forming the liquid droplet guiding portion includes forming a plurality of minute recessed and protruded portions that are loosely and densely distributed in the discharging direction of the liquid droplet on the surface of the penetrating portion.

In this method, the plurality of minute recessed and protruded portions are loosely and densely distributed in the discharging direction of the liquid droplet. The arrangement applies a resistance to an discharged liquid droplet in a particular direction, and facilitates the liquid droplet having a subtle inclination to be emitted from the penetrating portion. Even if there is a variation in the direction of the penetrating portion, the flying direction of the liquid droplet can be adjusted by correcting the discharging direction thereof in accordance with the direction of the penetrating portion. As a result, that makes it easier for even a miniaturized liquid droplet to land on a target position thereof accurately. Therefore, the method can provide the liquid droplet discharging head that allows improvement in the landing position accuracy.

A method for manufacturing a liquid droplet discharging apparatus according to a tenth aspect is the manufacturing method of a liquid droplet discharging apparatus including the liquid droplet discharging head manufactured by the method according to the ninth aspect.

This discharging apparatus includes the liquid droplet discharging head that can provide the improved landing position accuracy. Therefore, the method can provide a liquid droplet discharging apparatus that can produce higher quality drawings.

BRIEF DESCRIPTION OF THE DRAWINGS

The invention will be described with reference to the accompanying drawings, wherein like numbers reference like elements.

FIG. 1A is a plan view of the example thereof.

FIG. 1B is a sectional view taken along a line A-A of FIG. 1A.

FIG. 1C is a sectional view taken along a line B-B of FIG. 1B.

FIG. 2A is a schematic view of the manufacturing method.

FIG. 2B is a sectional view taken along a line A-A of FIG. 2A.

FIG. 3A is a plan view of the example thereof.

FIG. 3B is a sectional view taken along a line A-A of FIG. 3A.

FIG. 3C is a sectional view taken along a line B-B of FIG. 3B.

FIG. 4A is a schematic view of the manufacturing method.

FIG. 4B is a sectional view taken along a line A-A of FIG. 4A.

FIG. 5A is a plan view of the example thereof.

FIG. 5B is a sectional view taken along a line A-A of FIG. 5A.

FIG. 6A is a schematic view of a photo mask used in the manufacturing method.

FIG. 6B shows a state in which the photo mask is placed on a nozzle plate material.

FIG. 8A is a plan view of the example thereof.

FIG. 8B is a sectional view taken along a line A-A of FIG. 8A.

FIG. 8C is a sectional view taken along a line B-B of FIG. 8B.

FIG. 9A is a schematic view of the manufacturing method.

FIG. 9B is a sectional view taken along a line A-A of FIG. 9A.

FIG. 10A is a plan view of the example thereof.

FIG. 10B is a sectional view taken along a line A-A of FIG. 10A.

FIG. 11A is a schematic view of a photo mask used in the manufacturing method.

FIG. 11B shows a state in which the photo mask is placed on a nozzle plate material.

FIG. 12A is a schematic perspective view thereof.

FIG. 12B is a schematic sectional view thereof.

FIGS. 14A to 14C schematically show an example of a nozzle plate of a liquid droplet discharging head according to a first modification.

FIG. 14A is a plan view of the example thereof.

FIG. 14B is a sectional view taken along a line A-A of FIG. 14A.

FIG. 14C is a partially enlarged view of FIG. 14B.

FIGS. 15A to 15C schematically show an example of a nozzle plate of a liquid droplet discharging head according to a second modification.

FIG. 15A is a plan view of the example thereof.

FIG. 15B is a sectional view taken along a line A-A of FIG. 15A.

FIG. 15C is a partially enlarged view of FIG. 15B.

FIG. 16A is a plan view of the example thereof.

FIG. 16B is a sectional view taken along a line A-A of FIG. 16A.

DESCRIPTION OF EXEMPLARY EMBODIMENTS

Embodiments of the invention will now be described with reference to the accompanying drawings.

First Embodiment

A first embodiment of the invention describes a liquid droplet discharging head in which a nozzle as a penetrating portion includes a spiral narrow groove used as a liquid droplet guiding portion. The liquid droplet guiding portion means a physical structure such as a groove formed by carving a surface of the penetrating portion formed in a substrate or a protruded portion formed on the substrate, with a chemical structure such as lyophilic and lyophobic regions formed on the surface of the penetrating portion. Any of the structures can serves to help a liquid droplet pass through the penetrating portion.

First, a description will be given of a structure of the liquid droplet discharging head incorporated in a liquid droplet discharging apparatus, according to exemplary embodiments of the invention.

Figure 12A:
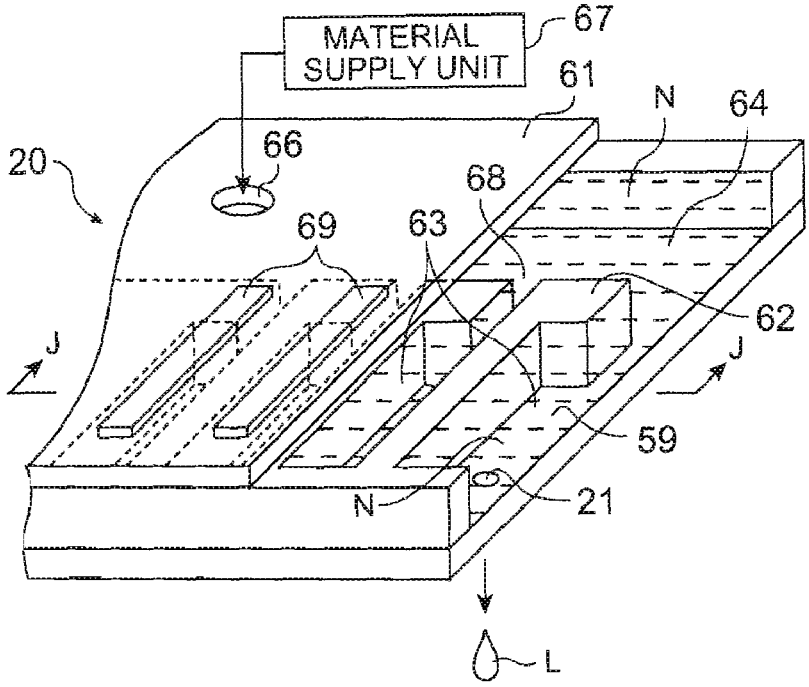
FIGS. 12A and 12B partially show a main part of the liquid droplet discharging head according to the first embodiment.
Figure 12B:
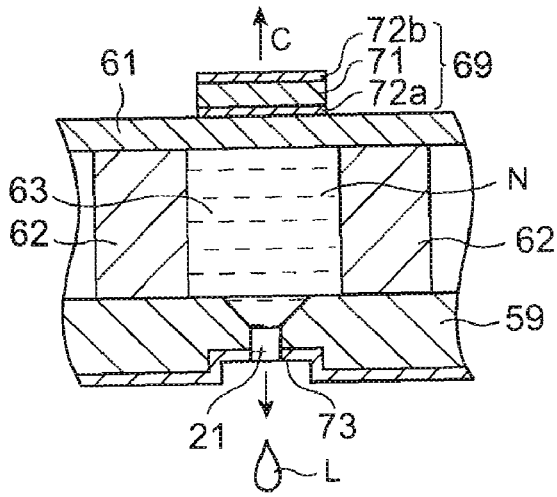

FIGS. 12A and 12B partially show a main part of the liquid droplet discharging head. FIG. 12 is a schematic perspective view of the main part thereof and FIG. 12B is a schematic sectional view of the main part thereof.

As shown in FIG. 12A, a liquid droplet discharging head 20 has a nozzle plate 59 as a second substrate, a vibration plate 61 which is opposite thereto and a partition member 62 as a first substrate connecting the nozzle plate 59 to the vibration plate 61. Between the nozzle plate 59 and the vibration plate 61 are provided a plurality of material chambers 63 as pressure chambers and a liquid reservoir 64 formed by the partition members 62. The material chambers 63 and the liquid reservoir 64 are in communication with each other via a passage 68.

The vibration plate 61 has a material supply hole 66 formed therein. The material supply hole 66 is connected to a material supply unit 67, which supplies a material N to the material supply hole 66. The material N supplied as mentioned fills the liquid reservoir 64 and passes through the passage 68 to fill the material chamber 63.

As shown in FIG. 12B, the nozzle plate 59 has a nozzle 21 for discharging the material N as a liquid droplet L from the material chamber 63. The vibration plate 61 has a material pressurizer 69 on a reverse side of a surface thereof facing the material chamber 63. The material pressurizer 69 works in concert with the material chamber 63. The material pressurizer 69 has a piezoelectric element 71 and a pair of electrodes 72*a* and 72*b* having the piezoelectric element 71 therebetween. The piezoelectric element 71 bends and deforms in a manner protruding outwardly, as indicated by arrow C, due to electric conduction to the electrodes 72*a* and 72*b*, whereby a capacity of the material chamber 63 increases. Then, an amount of the material N equivalent to the increased capacity flows into the material chamber 63 from the liquid reservoir 64 through the passage 68.

Thereafter, when the electric conduction to the piezoelectric element 71 is stopped, shapes of the piezoelectric element 71 and the vibration plate 61 return to their original ones, whereby the capacity of the material chamber 63 also returns to its initial capacity. Accordingly, a pressure of the material N inside the material chamber 63 increases and the material N is thereby discharged as the liquid droplet L from the nozzle 21. For example, a lyophobic material layer 73 composed of an Ni-tetrafluoroethylene eutectoid plating layer may be formed in a periphery of the nozzle 21 to prevent a flight diversion of the liquid droplet L, a hole clogging in the nozzle 21 and the like.

Figure 1A:
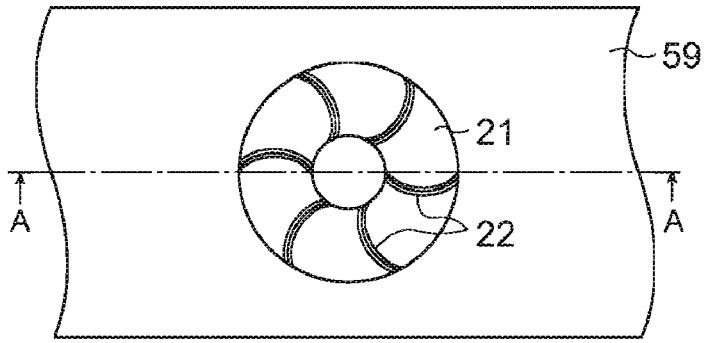
FIGS. 1A to 1C schematically show an example of a nozzle plate of a liquid droplet discharging head according to a first embodiment of the invention.
Figure 1B:
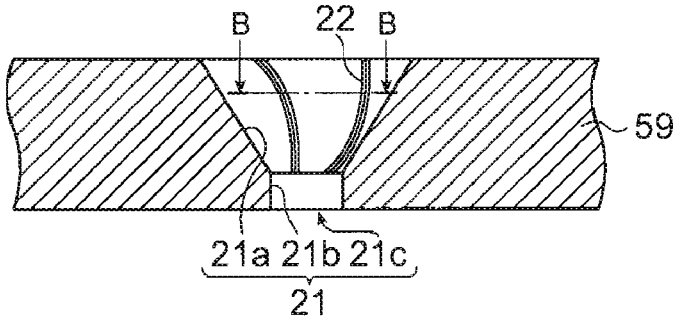
Figure 1C:
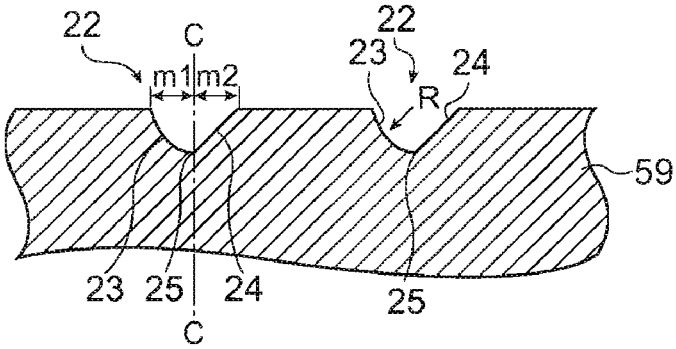
Figure 2A:
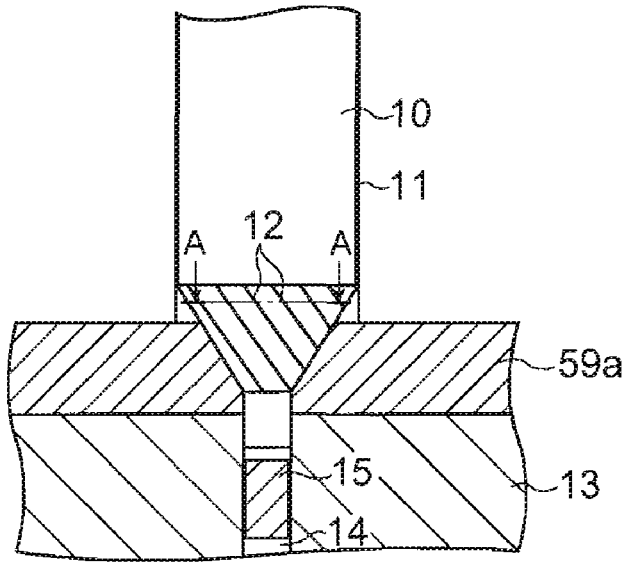
FIGS. 2A and 2B illustrate a method for manufacturing the nozzle plate of the liquid droplet discharging head according to the first embodiment.
Figure 2B:
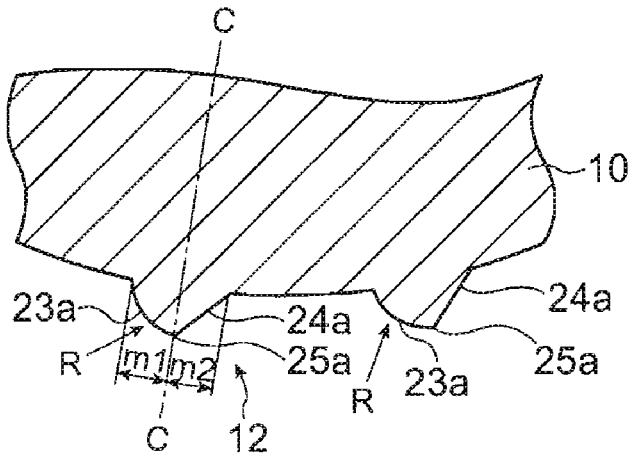

FIGS. 1A and 1B schematically show an example of a nozzle plate of the liquid droplet discharging head according to the first embodiment. FIG. 1A is a plan view thereof. FIG. 1B is a sectional view taken along line A-A of FIG. 1A. FIG. 1C is a sectional view taken along line B-B of FIG. 1B. FIGS. 2A and 2B illustrate a method for manufacturing the nozzle plate of the liquid droplet discharging head. FIG. 2A is a schematic view thereof and FIG. B is a sectional view taken along line A-A of FIG. 2A. Referring to FIGS. 1A to 1C and FIGS. 2A and 2B, a description will be given of the nozzle plate of the liquid droplet discharging head according to the first embodiment and the manufacturing method of the nozzle plate thereof.

As shown in FIG. 1A, the nozzle 21 as the penetrating portion is formed in the nozzle plate 59 as the second substrate. The nozzle plate 59 is one of components included in the liquid droplet discharging head 20. The nozzle 21 has a plurality of liquid droplet guiding portions 22 which can guide the liquid droplet L. As shown in the drawing, the plurality of liquid droplet guiding portions 22 formed on the nozzle 21 includes six guiding portions. The present embodiment uses the six guiding portions 22. However, this is not the only option. The number thereof may be increased or decreased as necessary. Increasing the number of the liquid droplet guiding portions 22 allows the liquid droplet L to be efficiently guided from the nozzle 21 to an discharging outlet 21*c* (See FIG. 1B). Alternatively, decreasing the number of the liquid droplet guiding portion 22 leads to efficient formation thereof, since a manufacturing thereof is simplified due to the small number thereof. The nozzle plate 59 employed in the present embodiment is made of stainless steel, but the material thereof is not limited thereto. For example, in a case in which the first and second substrates are integrally formed with each other, a same material as that of the first substrate can be used for the nozzle plate 59. The nozzle plate 59 may be made of SUS (stainless used steel) or the like, where a base layer composed of a metallic film, a dielectric film, an organic film or the like may be formed on a substrate surface.

As shown in FIG. 1B, the nozzle 21 as the penetrating portion formed in the nozzle plate 59 includes first and second penetrating portions 21*a*, 21*b* and the discharging outlet 21*c*. The first penetrating portion 21*a* has a conical (mortar-like) shape and the second penetrating portion 21*b* has a cylindrical shape. Each of the liquid droplet guiding portions 22 is formed continuously from the first penetrating portion 21*a* to the second penetrating portion 21*b*. The first and second penetrating portions 21*a* and 21*b* are in communication with each other to discharge the liquid droplet L from the discharging outlet 21*c*. The first and second penetrating portions 21*a* and 21*b* have a diameter of approximately 50 μm and 20 μm, respectively. The number of the nozzle 21 varies with applications of the liquid droplet discharging head 20 (See FIGS. 12A and 12B). The nozzle plate has the nozzle 21 having a plurality of nozzles.

In FIG. 1B, each of the liquid droplet guiding portions 22 is formed from a top surface side (an upper side in the drawing) of the nozzle plate 59 toward a bottom surface side (a lower side therein) thereof in a spiral manner. Each liquid droplet guiding portion 22 is a narrow groove formed on a surface of the first penetrating portion 21*a*. As shown in the drawing, the liquid droplet guiding portions 22 each extend with a curvature in an discharging direction of the liquid droplet L.

As shown in FIG. 1C, the liquid droplet guiding portion 22 includes first and second lines 23 and 24. There is a pointed end portion 25 at an intersection of the first and second lines 23 and 24. The first and second lines 23 and 24 are positioned axisymmetrically with respect to a center line C-C. In addition, a distance m1 between the center line C-C and the first line 23 is approximately equal to a distance m2 between the center line C-C and the second line 24. The first line 23 is a curve, whereas the second line 24 is a straight line. The round first line 23 has a round portion R. In the present embodiment, although the first line 23 is round and the second line 24 is straight, that is not the only option. For example, the first line 23 may be a straight line, whereas the second line 24 may be a curve.

In FIG. 1C, each of the liquid droplet guiding portions 22 has an approximately triangular sectional shape and is a recessed groove. The recessed groove is narrow and is approximately 1 μm in both width and depth. The sectional shape of the recessed groove is not limited to a triangular shape and may be a polygonal shape, such as a rectangular or pentagonal one. Additionally, the sectional shape of the liquid droplet guiding portion 22 is not limited to the recessed groove. The sectional shape thereof may be a protruded one. In this case, like the recessed groove, the protruded sectional shape is not limited to being triangular, and may be polygonal such as being rectangular or pentagonal.

Next, a description will be given of a method for manufacturing the liquid droplet guiding portion.

As shown in FIG. 2A, a structure of a die may be used as a structural example of the liquid droplet guiding portion used in the manufacturing method according to the first embodiment. The structure thereof roughly includes a punch 10, a stripper plate 11, a die plate 13 and a hole 14 formed in the die plate 13. A protruded portion 12 corresponding to the liquid droplet guiding portion 22 (See FIGS. 1B and 1C) is spirally formed (See FIG. 1A) at a conical part of the punch 10. The punch 10 has a shape matching with the nozzle 21 (See FIGS. 1B and 1C). The hole 14 in the die plate 13 is formed so as to be slightly larger than a diameter of a tip of the punch 10.

The nozzle plate material 59*a* is placed on the die plate 13. The punch 10 is abutted against the nozzle plate material 59*a* to penetrate therethrough. Then, a punched-out slug 15 is produced and falls in the hole 14. This results in a formation of the nozzle 21 as the penetrating portion that has the first and second penetrating portions 21*a* and 21*b*. Simultaneously, abutment of the protruded portion 12 against the nozzle plate material 59*a* allows a formation of the liquid droplet guiding portion 22 (See FIG. 1A) in the first penetrating portion 21*a*. Additionally, since the protruded portion 12 is spirally formed on the conical part of the punch 10, the liquid droplet guiding portion 22 (See FIG. 1A) can also be spirally formed. Then, the nozzle plate 59 can be formed that includes the liquid droplet guiding portion 22 (See FIG. 1B) spirally formed in the first penetrating portion 21*a* (See FIG. 1B).

As shown in FIG. 2B, the protruded portion 12 includes a plurality of protruded portions 12 that are protrudingly formed on the conical part of the punch 10. The number of the protruded portion 12 corresponds to that of the liquid droplet guiding portion 22 (See FIG. 1A). A first protruded portion 23*a* is formed at a position corresponding to the first line 23 (See FIG. 1C). Similarly, a second protruded portion 24*a* is formed at a position corresponding to the second line 24 (See FIG. 1C). Additionally, a pointed end portion 25*a* is formed at a position corresponding to the pointed end portion 25 (See FIG. 1C). The first protruded portion 23*a* is a curve and the second protruded portion 24*a* is a straight line. The first and second protruded portions 23*a* and 24*a* are positioned axisymmetrically with respect to the center line C-C. Furthermore, the protruded portions 23*a* and 24*a* are positioned such that the distance m1 of the first protruded portion 23*a* from the center line C-C is approximately equal to the distance m2 of the second protruded portion 24*a* therefrom. The pointed end portion 25*a* is at an intersection of the first and second protruded portions 23*a* and 24*a*.

The punch 10, which includes the protruded portion 12 having the pointed end portion 25*a* made of the first and second protruded portions 23*a* and 24*a*, is abutted against the nozzle plate material 59*a*. The abutment allows the formation of the liquid droplet guiding portion 22 (See FIG. 1C) having the pointed end portion 25*a* made of the first and second lines 23 and 24. In addition, the first and second lines 23 and 24 can be positioned axisymmetrically with respect to the center line C-C. Furthermore, the distances m1 and m2 (See FIG. 1C) of the first and second lines 23 and 24 from the centerline C-C can be made approximately equal to each other.

The above description is about the nozzle shape of the nozzle plate included in the liquid droplet discharging head according to the first embodiment and the manufacturing method thereof. Described next will be a method for discharging a liquid droplet from the liquid droplet discharging head.

The liquid droplet L, which is discharged from the discharging outlet 21*c* after passing through the nozzle 21, is emitted along the liquid droplet guiding portion 22. The liquid droplet guiding portion 22 is formed on the first penetrating portion 21*a* having the conical (mortar-like) shape as the narrow spiral groove. Thus, the liquid droplet L is easily discharged from the discharging outlet 21*c* along the narrow spiral groove. Accordingly, a rotational force can easily be applied to the liquid droplet L discharged from the discharging outlet 21*c* in a rotational direction, which makes it easier for the liquid droplet L to be directed to a center of the nozzle 21. Additionally, the liquid droplet L discharged from the nozzle 21 can fly relatively straight in an air, so that it can land on a target position thereof more easily and accurately. Moreover, since the liquid droplet guiding portion 22 has the pointed end portion 25 including the first and second lines 23 and 24, a further rotational force can easily be applied to the liquid droplet L. Therefore, the liquid droplet discharging head 20 (See FIGS. 12A and 12B) allows improvement in a landing position accuracy of the liquid droplet L.

Therefore, the first embodiment provides the following advantageous effects.

1. Each of the liquid droplet guiding portions 22 formed at the nozzle 21 as the penetrating portion extends with a curvature in the discharging direction of the liquid droplet L. This facilitates the application of a rotational force to the liquid droplet L. Accordingly, the liquid droplet L can easily be focused to the center of the nozzle 21. Then, since the liquid droplet L from the nozzle 21 will hardly be influenced by air resistance, it can fly straight in the air. As a result, the liquid droplet L can land on a target position thereof more easily and accurately.

2. The plurality of pointed end portions 25 are formed at the liquid droplet guiding portion 22 on the nozzle 21 and exist in the direction intersecting with the discharging direction of the liquid droplet L. Thus, the intersection of the liquid droplet L with each of the pointed end portions 25 facilitates the application of a rotational force to the liquid droplet L. Then, the liquid droplet L can more easily be focused to the center of the nozzle 21. Accordingly, the liquid droplet L discharged from the nozzle 21 will fly straight in the air, thereby landing on a target position thereof more easily and accurately.

3. The plurality of liquid droplet guiding portions 22 having the pointed end portions 25 including the first and second lines 23 and 24 are formed on a surface of the first penetrating portion 21*a* and extend with a curvature in the discharging direction of the liquid droplet L. This facilitates the application of a rotational force to the liquid droplet L, whereby the liquid droplet can more easily be focused to the center of the nozzle 21. Accordingly, the liquid droplet L discharged from the nozzle 21 will fly relatively straight in the air. As a result, that makes it easier for the liquid droplet L to land on a target position thereof accurately.

4. When discharging the liquid droplet L while rotating in a rotational direction, including the round portion R in one of the first and second lines 23 and 24 facilitates the liquid droplet L to rotate in a particular rotational direction. This can increase a directivity of the liquid droplet L, thereby improving the landing position accuracy.

5. Since the first line 23 is longer than the second line 24, the direction of each of the pointed end portions 25 easily deviates in a particular direction. This can increase the directivity of the liquid droplet L in a particular rotational direction. Therefore, the landing position accuracy of the liquid droplet L can be improved.

6. The first and second lines 23 and 24 are positioned at an approximately equal distance from the pointed end portions 25. Thus, directions of the plurality of pointed end portions 25 can easily be aligned in a particular direction. This can increase the directivity of the liquid droplet L in a particular rotational direction. Therefore, the landing position accuracy thereof can be improved.

7. The first and second lines 23 and 24 are positioned symmetrically with respect the pointed end portions 25. This allows a frictional resistance applied to the liquid droplet L to be maintained at an approximately equal level. Thus, diversions in the discharging direction of the liquid droplet L can be reduced, which can improve the landing position accuracy thereof.

Second Embodiment

A second embodiment of the invention describes a liquid droplet discharging head including a linear groove formed at a nozzle section of the nozzle plate. The linear groove is formed on the first penetrating portion.

Figure 3A:
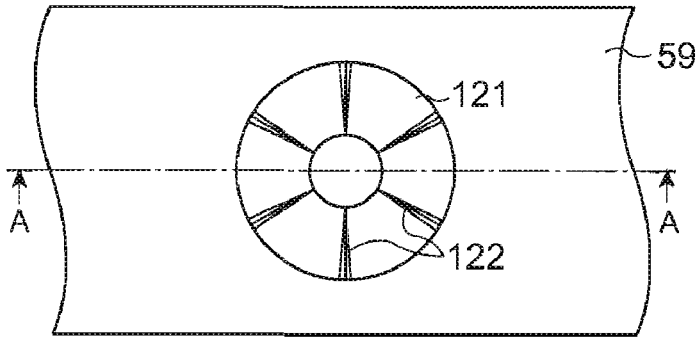
FIGS. 3A to 3C schematically show an example of a nozzle plate of a liquid droplet discharging head according to a second embodiment of the invention.
Figure 3B:
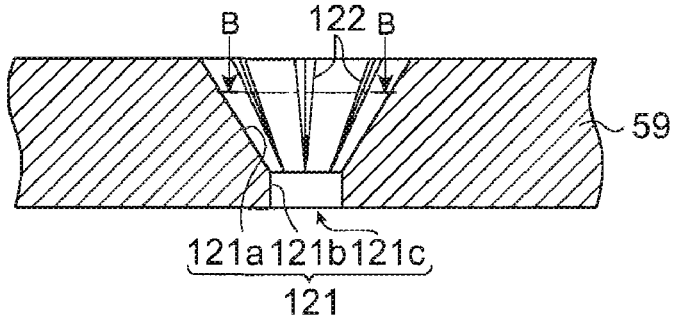
Figure 3C:
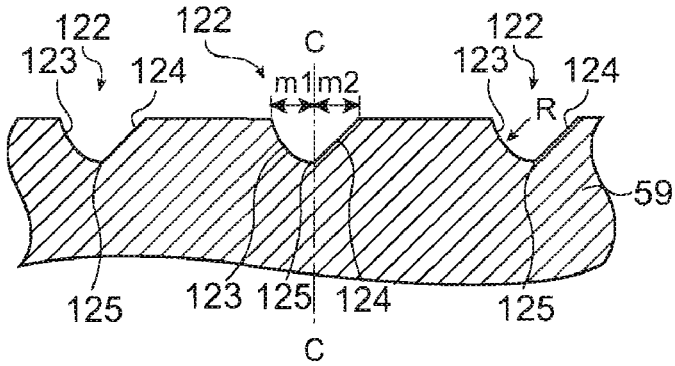
Figure 4A:
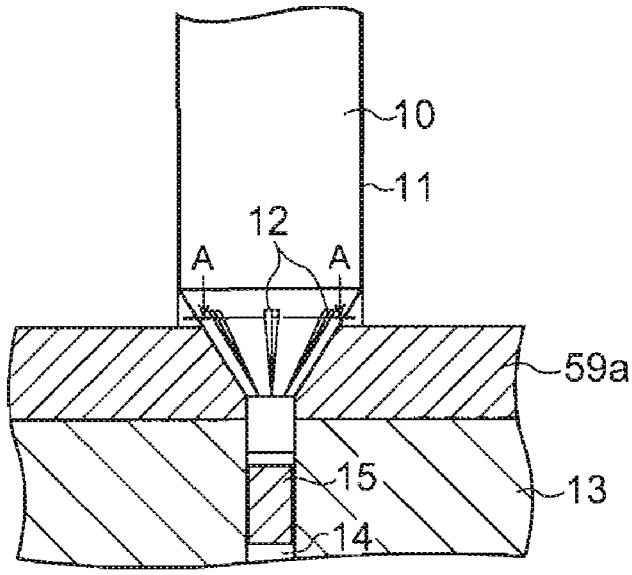
FIGS. 4A and 4B illustrate a method for manufacturing the nozzle plate of the liquid droplet discharging head according to the second embodiment.
Figure 4B:
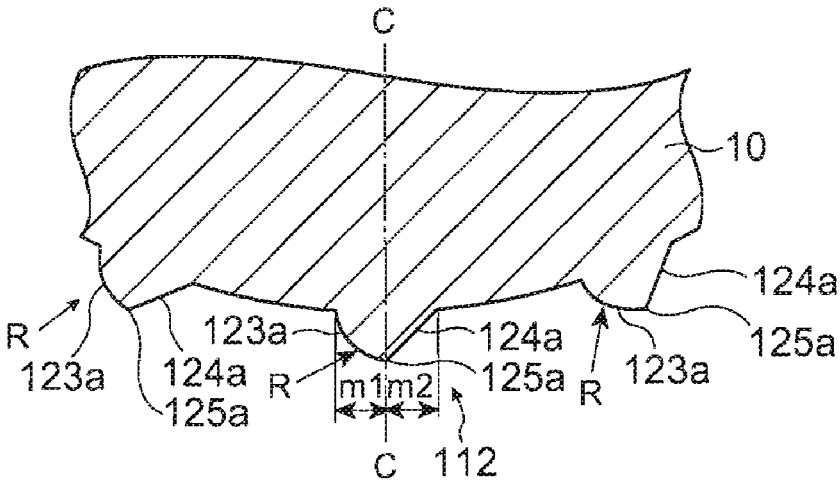

FIGS. 3A to 3C schematically show an example of the nozzle plate included in the liquid droplet discharging head according to the second embodiment. FIG. 3A is a plan view of the example thereof, FIG. 3B is a sectional view of the example thereof taken along a line A-A of FIG. 3A. FIG. 3C is a sectional view of the example thereof taken along a line B-B of FIG. 3B. FIGS. 4A and 4B illustrate a method for manufacturing the nozzle plate included in the liquid droplet discharging head. FIG. 4A is a schematic view of the nozzle plate and FIG. 4B is a sectional view thereof taken along a line A-A of FIG. 4B. Referring to FIGS. 3A to 3C and 4A and 4B, a description will now be given of the nozzle plate included in the liquid droplet discharging head according to the second embodiment and the manufacturing method thereof. Unlike the first embodiment described above, the second embodiment employs a liquid droplet guiding portion formed as the linear groove, instead of the narrow spiral groove. The same components as those used in the first embodiment and components having the same functions as those therein are denoted by the same reference numerals and are not described below.

As shown in FIG. 3A, the nozzle plate 59 as the second substrate has a nozzle 121 as a penetrating portion. The nozzle 121 has a plurality of liquid droplet guiding portions 122 that can guide the liquid droplet L. In the drawing, the plurality of liquid droplet guiding portions 122 are linearly formed on the nozzle 121 and include six liquid droplet guiding portions 122.

As shown in FIG. 3B, the liquid droplet guiding portions 122 are formed on a surface of a first penetrating portion 121*a*. The liquid droplet guiding portions 122 are arranged continuously from the first penetrating portion 121*a* to the second penetrating portion 121*b*.

In FIG. 3B, each of the liquid droplet guiding portions 122 is formed from a top surface side (an upper side in the drawing) of the nozzle plate 59 toward a bottom surface side (a lower side therein) thereof in a linear manner. The liquid droplet guiding portions 122 are grooves and each of them extends in the discharging direction of the liquid droplet L, as shown in the drawing.

In FIG. 3C, the liquid droplet guiding portions 122 have the same shape as that of the liquid droplet guiding portions 22 (See FIG. 1C). Specifically first and second lines 123 and 124 correspond to the first and second lines 23 and 24, respectively, as shown in FIG. 1C. Additionally, on the first penetrating portion 121*a*, the liquid droplet guiding portions 122 are configured to be conical from the surface of the nozzle plate 59 toward the second penetrating portion 121*b*. Accordingly, a sectional area of each of the liquid droplet guiding portions 122 is smaller near the second penetrating portion 121*b* than near the surface of the nozzle plate 59. In other words, the first line 123 is formed to be shorter near the second penetrating portion 121*b* than near the surface of the nozzle plate 59. Additionally, the second line 124 is also formed in the same manner as the first line 123.

Now, a manufacturing method of the liquid droplet guiding portion will be described.

As shown in FIG. 4A, the punch 10 has a protruded portion 112 that is linearly (See FIG. 3A) formed at a conical part thereof. The protruded portion 112 corresponds to each of the liquid droplet guiding portions 122 (See FIGS. 3B and 3C). The punch 10 has a shape matching with the nozzle 121 (See FIGS. 3B and 3C). Additionally, the hole 14 formed in the die plate 13 has a diameter that is slightly larger than a tip diameter of the punch 10. Along with the linear formation of the protruded portion 112 at the conical part of the punch 10, abutment of the punch 10 against the nozzle plate material 59*a* allows the formation of the first penetrating portion 121*a*. Consequently, the first penetrating portion 121*a* can have the liquid droplet guiding portion 122 (See FIG. 3A) linearly formed on the surface thereof. Then, the nozzle plate 59 can be produced that has the first penetrating portion 121*a* (See FIG. 3B) including the linearly formed liquid droplet guiding portion 122 (FIG. 3B). The protruded portion 112 has a shape corresponding to that of the liquid droplet guiding portion 122 and is configured to be conical from the first penetrating portion 121*a* toward the second penetrating portion 121*b*.

As shown in FIG. 4B, the protruded portion 112 which are protrudingly formed at the conical part of the punch 10 includes a plurality of protruded portions 112. The number of the protruded portion 112 corresponds to that of the liquid droplet guiding portion 122 (See FIG. 3A). The protruded portion 112 has a section of the same shape as that shown in FIG. 2B in the first embodiment. However, in the first penetrating portion 121*a*, the protruded portion 112 (See FIG. 4A) is formed in the conical shape from the first penetrating portion 121*a* toward the second penetrating portion 121*b*. Accordingly, a sectional area of the protruded portion 112 is smaller near the second penetrating portion 121*b* than near the surface of the nozzle plate 59. Specifically, the first line 123*a* is formed to be shorter near the second penetrating portion 121*b* than near the surface of the nozzle plate 59. Similarly, the second line 124*a* is formed in the same manner as the first line 123*a*. Using the punch 10 formed as described above allows a formation of the liquid droplet guiding portion 122, which is shown in FIGS. 3A, 3B and 3C.

The above description is about the nozzle shape of the nozzle plate included in the liquid droplet discharging head according to the second embodiment and the manufacturing method thereof. Hereinafter, a description will be given of a method for discharging a liquid droplet from the liquid droplet discharging head.

The liquid droplet L, which is discharged from the discharging outlet 121*c* after passing through the nozzle 121, is emitted along the liquid droplet guiding portion 122. The liquid droplet guiding portion 122 is disposed on an inclined surface of the first penetrating portion 121*a* so as to form a linear groove. Accordingly, the liquid droplet L is easily discharged from the discharging outlet 121*c* along the linear groove. Thus, the liquid droplet L, when discharged from the discharging outlet 121*c*, flows along the liquid droplet guiding portion 122 having the conical shape from the first penetrating portion 121*a* toward the second penetrating portion 121*b*. This facilitates the liquid droplet L to be directed toward a center of the nozzle 121. Then, the liquid droplet L discharged from the nozzle 121 flies relatively straight in the air, so that the liquid droplet L can land on a target position thereof more easily and accurately. Therefore, the liquid droplet discharging head 20 (See FIGS. 12A and 12B) allows improvement in the landing position accuracy of the liquid droplet L.

The second embodiment provides the following advantageous effect in addition to those in the first embodiment:

8. The liquid droplet guiding portion 122 is linearly formed as the groove having the conical shape which is smaller near the second penetrating portion 121*b* than near the surface of the nozzle plate 59. The simple shape facilitates manufacturing of the punch 10, thereby providing productive efficiency.

Third Embodiment

A third embodiment of the invention describes a liquid droplet discharging head having patterns with different wettabilities at the nozzle section of the nozzle plate. Those patterns having different wettabilities are formed at the first penetrating portion.

Figure 5A:
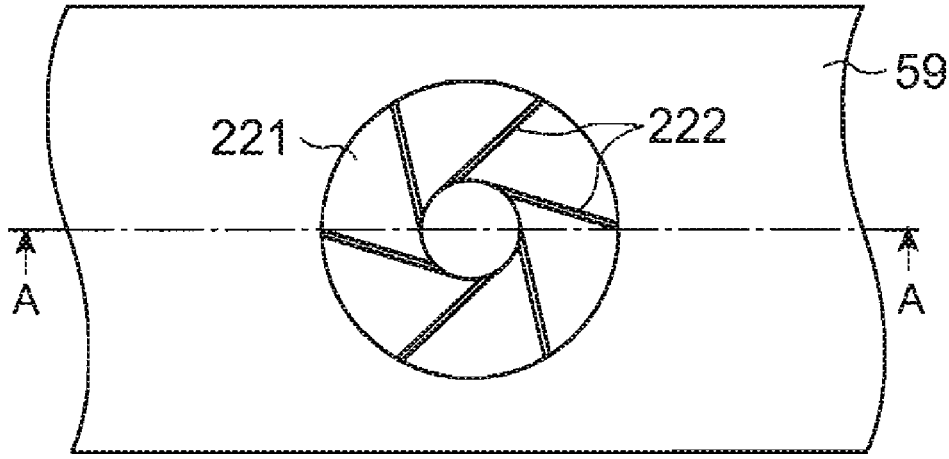
FIGS. 5A to 5B schematically show an example of a nozzle plate of a liquid droplet discharging head according to a third embodiment of the invention.
Figure 5B:
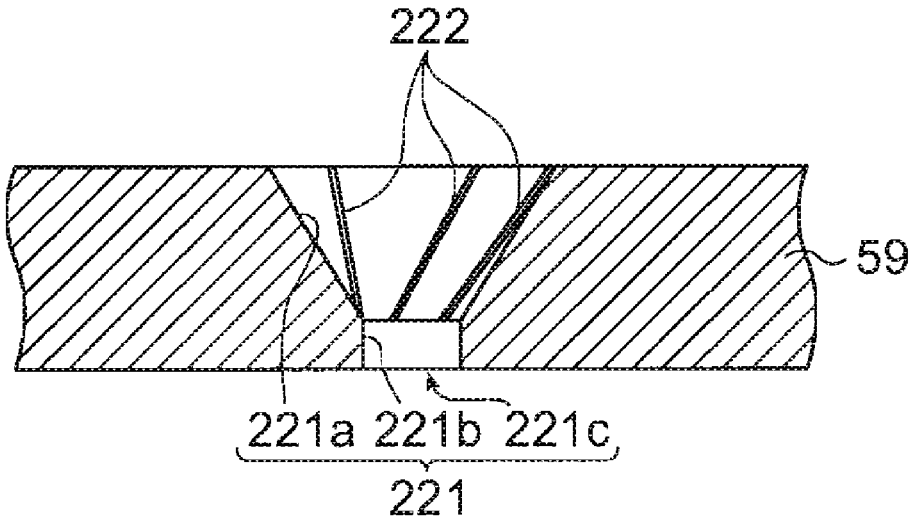
Figure 6A:
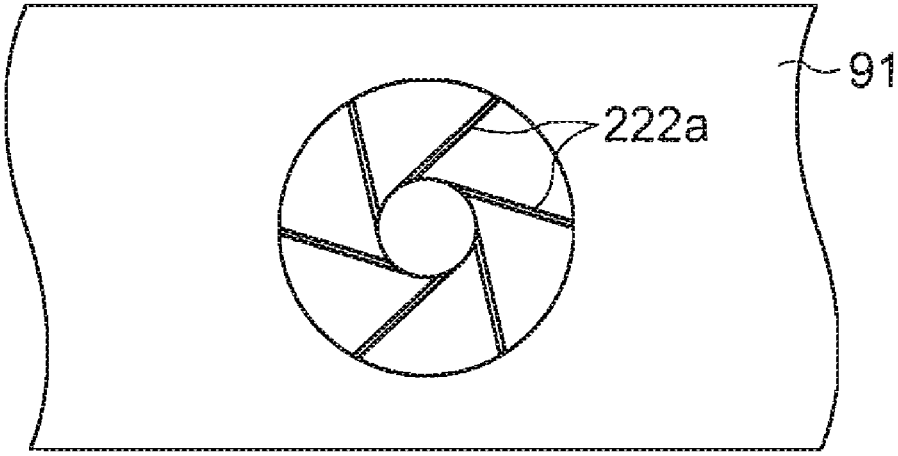
FIGS. 6A and 6B illustrate a method for manufacturing the nozzle plate of the liquid droplet discharging head according to the third embodiment.
Figure 6B:
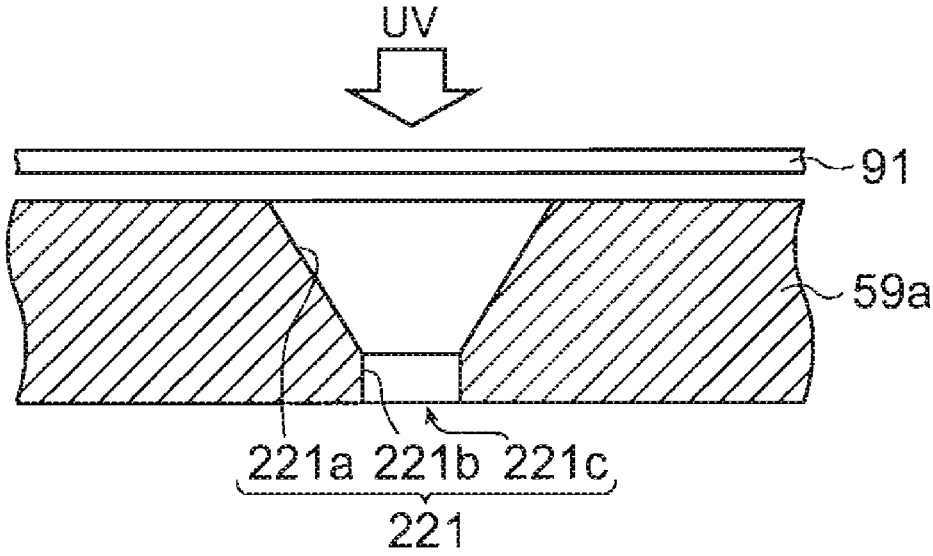
Figure 7:
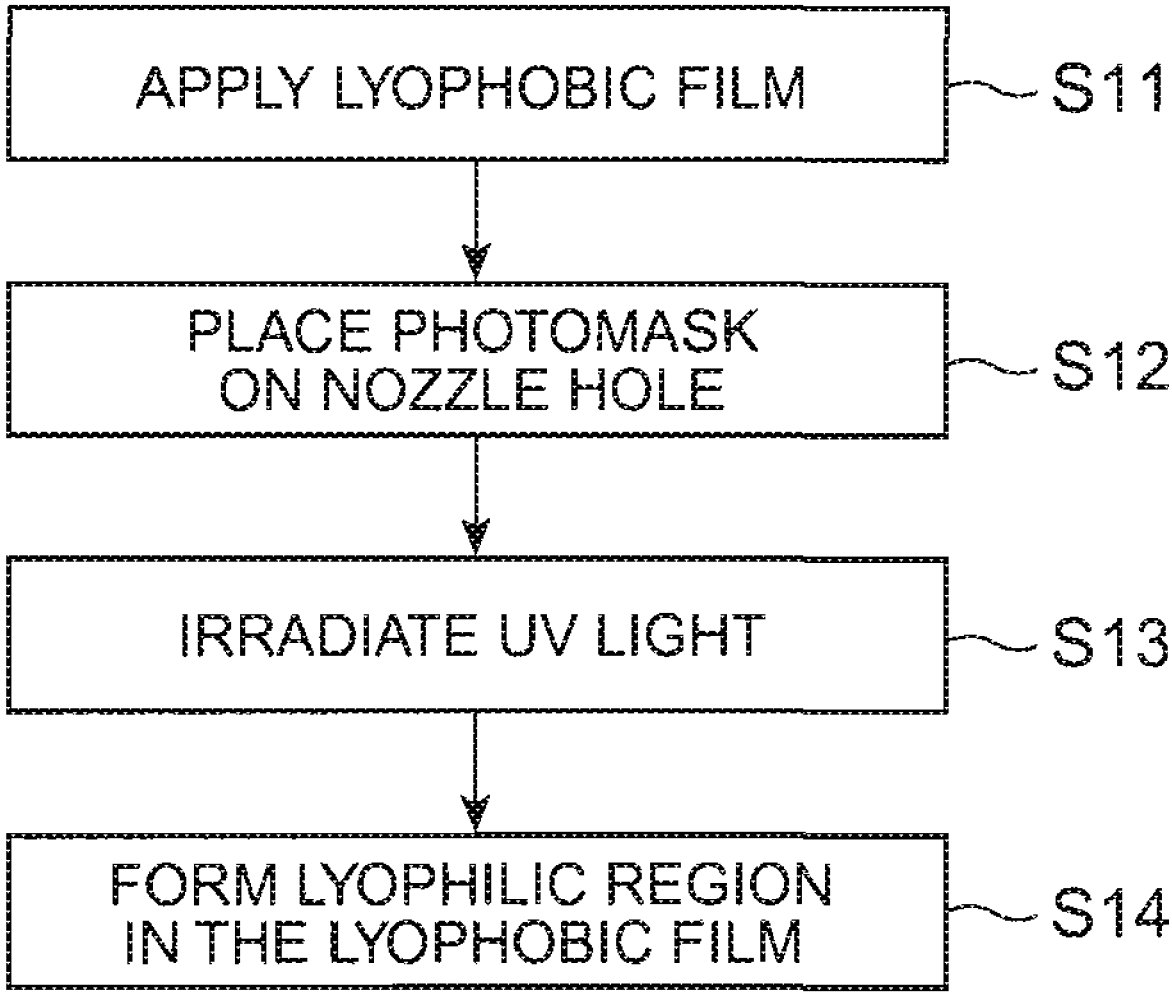
FIG. 7 shows a flowchart illustrating processes performed in the manufacturing method shown in FIGS. 6A and 6B.

FIGS. 5A and 5B schematically show an example of the nozzle plate included in the liquid droplet discharging head according to the third embodiment. FIG. 5A is a plan view of the example thereof and FIG. 5B is a sectional view taken along a line A-A of FIG. 5A. FIGS. 6A and 6B illustrate a method for manufacturing the nozzle plate included in the liquid droplet discharging head. FIG. 6A is a schematic view of a photomask and FIG. 6B shows a state in which the photomask is placed on a nozzle plate material. FIG. 7 shows a flowchart of processes performed in the manufacturing method of the nozzle plate included in the liquid droplet discharging head. Referring to FIGS. 5A to 7, a description will be given of the nozzle plate included in the liquid droplet discharging head according to the third embodiment and a manufacturing method thereof. Unlike the above first and second embodiments, the third embodiment employs liquid droplet guiding portions that are patterns having different wettabilities, as an alternative to the narrow spiral grooves or the linear grooves. The same components as those used in the first and second embodiments and components having the same functions as those provided therein are denoted by the same reference numerals and are not described below.

As shown in FIG. 5A, the nozzle plate 59 as the second substrate has a nozzle 221 as a penetrating portion formed therein. The nozzle 221 has a plurality of liquid droplet guiding portions 222 that can guide the liquid droplet L. As in the drawing, the liquid droplet guiding portions 222 on the nozzle 221 have a linear shape and include six liquid droplet guiding portions 222. Each of the liquid droplet guiding portions 222 is a region exhibiting a low wettability with respect to the liquid droplet L, thus being highly lyophobic. The remaining region where the liquid droplet guiding portions 222 are not formed exhibits a high wettability with respect thereto, thus being highly lyophilic.

As shown in FIG. 5B, the first penetrating portion 221*a* has the liquid droplet guiding portions 222 formed on a surface thereof. The liquid droplet guiding portions 222 extend continuously from the first penetrating portion 221*a* toward the second penetrating portion 221*b*.

In FIG. 5B, the liquid droplet guiding portions 222 are formed from a top surface side (an upper side in the drawing) of the nozzle plate 59 toward a bottom surface side (a lower side therein) thereof in a linear manner. The liquid droplet guiding portions 222 are lyophobic patterns that extend in the discharging direction of the liquid droplet L, as shown in the drawing.

Described next will be a manufacturing method of the liquid droplet guiding portions.

FIG. 6A shows a photomask 91. In the drawing, the photomask 91 includes patterns 222*a* for forming each of the liquid droplet guiding portions 222 on the nozzle 221 of the nozzle plate 59.

As shown in FIG. 6B, the photomask 91 is placed on the nozzle plate material 59*a* with the nozzle 221. Then, UV light (ultraviolet light) is irradiated from a top surface side (an upper side in the drawing) of the photomask 91. In this case, part of the UV light is blocked by the patterns 222*a* of the photomask 91 and therefore is not partially incident on a surface of the first penetrating portion 221*a*. Thus, the first penetrating portion 221*a* can obtain regions exhibiting both lyophobic and lyophilic properties relatively with respect to the liquid droplet L on the surface thereof. Using the method, for example, the liquid droplet guiding portion 222 (See FIG. 5A) can be made either relatively lyophobic or lyophilic. More details of the manufacturing method thereof will now be described with reference to FIG. 7.

In step S11 shown in FIG. 7, a lyophobic film is formed on the nozzle plate material 59*a*. The lyophobic film may be formed using a monomolecular film. A monomolecular film is composed of an aggregation of molecules including a functional group bondable with constituent atoms of a base material surface, a functional group formed opposite to the above-mentioned functional group and capable of changing surface properties (controlling a surface energy) of the base material, such as a lyophilic or lyophobic group, and a linear carbon chain or a partially-branched carbon chain that links those functional groups.

A self-assembled film is composed of a bonding functional group reactive to the constituent atoms of the base material surface and other linear-chain molecules. The film is formed by aligning compound molecules which significantly exhibit high alignment properties due to interaction between the linear-chain molecules. Unlike a resin film such as a photoresist material, the self-assembled film is formed by aligning monomolecules. Accordingly, the formed film has a thin thickness. Additionally, the thickness of the thin film can be equalized at molecular level. Since the same molecules are located on a surface of the film, the surface thereof can be made even and also can have excellent lyophobic or lyophilic properties.

For example, fluoroalkylsilane may be used as a compound for forming a self-assembled film on a base material surface. Fluoroalkylsilane increases lyophobic properties of the base material with respect to a polar solvent such as water, because a fluoroalkyl group is positioned on a side opposite to the base material surface of the film. Concrete examples of compounds for forming a self-assembled film include fluoroalkylsilanes (hereafter referred to as "FAS") such as heptadecafluoro-1,1,2,2-tetrahydrodecyltricthoxysilane, heptadecafluoro-1,1,2,2-tetrahydrodecyltrichlorosilane, tridecafluoro-1,1,2,2-tetrahydrooctyltriethoxysilane, and trifluoropropyl-trimethoxysilane. It is preferable to use a single compound, or alternatively, a combination of two or more compounds may be used. Any of the compounds is expressed by a structural formula of $R_nSiX_{(4-n)}$ (X is a hydrolysis group), where silanol is formed by hydrolysis and reacts with the hydroxyl group on the surface of the base material (e.g. glass or silicon) to bond therewith by siloxane bonding. Meanwhile, symbol R represents a fluoroalkyl group such as $CF_3$ or $CF_2$, so that the base material surface can be changed into a nonwettable surface (surface with low surface energy).

A self-assembled film is obtained by putting any of the above-described compounds as a raw material and a base material together in a hermetically sealed container. Leaving them therein under a room temperature for approximately two or three days allows a formation of a self-assembled film on the base material. Alternatively, holding the sealed container as a whole at approximately 100 degrees centigrade allows the film formation on the base material in approximately three hours. These are the techniques for forming a self-assembled film from a gas phase. However, the self-assembled film can also be formed from a liquid phase. For example, after soaking a base material in a solvent containing a raw material compound, cleaning and drying it allows a self-assembled film to be formed on the base material.

Examples of other compounds include sulfur-containing organic molecules having sulfur-containing functional groups such as a thiol (—SH) group, a disulfide (—S—S) group, a monosulfide (—S—) group and thiophene. Among them, it is preferable to use organic molecules having the thiol group or the disulfide group, and particularly organic molecules having the thiol group. Such organic molecules, for example, may be linear-chain or branched, aliphatic saturated or unsaturated alkyl groups which may carry substituents and which have from 1 to 22 carbon atoms and preferably 4 to 18 atoms. Additionally, the substituents include a phenoxy group, a fluoroalkyl group having from 1 to 22 carbon atoms, a carboxyl group, an amino group, a cyano group, an amido group, an ester group, a sulfonic acid group, halogen atoms (such as a bromo group, a chloro group and an iodo group), a pyridine group, a peptide group, a ferrocene group, various polymer chains, bioactive substances such as proteins and nucleic acid bases, which may be further substituted. Concrete examples of the sulfur-containing organic molecules include octadecanthiol, azophenoxy dodecanthiol, perfluorooctyl pentanthiol, butanthiol, hexanthiol, octanthiol, dodecanthiol, dioctadecyldisulfide, cysteine, cystamine, thiophene, 18-mercapto-octadecyl amine, mercapto-octadecanole and mercapto-octadecanic acid.

There are various methods for forming the self-assembled film. In a vaporization-adsorption (including deposition) method, a material is left under the above sulfur-containing organic molecular atmosphere for a given time. Another method may be soaking of a material in a diluted solution containing the sulfur-containing organic molecules. When soaking the material in a solution of 1 mmol, a formation of a self-assembled film usually takes from a few minutes to 24 hours. In this case, a monomolecular film can be obtained that has a film thickness equivalent to a molecular chain length.

Next, in step S12 in FIG. 7, the photomask 91 is placed on the nozzle plate material 59*a*, as shown in FIG. 6B. In order to form the liquid droplet guiding portions 222 (See FIGS. 5A and 5B) on the first penetrating portion 221*a* with good precision, it is preferable to accurately place the photomask 91 thereon.

Then, in step S13 in FIG. 7, UV light is irradiated onto the nozzle plate material 59*a*. Patterning of a self-assembled film is performed so as to match with a shape of a functional thin film to be finally obtained. In the self-assembled film, the UV-irradiated part is removed. There can be obtained a region where the surface of the nozzle plate material 59*a* is exposed and the remaining region where the self-assembled film remains. The exposed region exhibits lyophilic properties due to good wettability with respect to the liquid droplet L, when relatively compared with the region having the remaining film. Meanwhile, the film-remaining region exhibits lyophobic properties due to nonwettability with respect thereto in a comparison with the exposed region.

As a patterning method of a self-assembled film, it is possible to use ultraviolet light irradiation, electronic beam irradiation, X-ray irradiation, a scanning probe microscope (SPM) method or the like. In the present embodiment, UV irradiation is preferable. This is performed by irradiating UV light having a predetermined wavelength onto the self-assembled film through the photomask 91 having an opening portion formed to form the shape of a functional thin film. The irradiation of UV light as shown above allows decomposition and removal of molecules forming the self assembled film, thereby enabling patterning. Therefore, with the UV light irradiation method, lyophilic and lyophobic portions can be formed in a manner matching with the shape of the pattern 222*a* formed at each photomask.

In this case, employed wavelength and irradiation time of the UV light are appropriately determined in accordance with a raw material compound of the self-assembled film. A preferable wavelength of UV light is equal to or less than 200 nm.

Finally, in step S14 in FIG. 7, a lyophilic region is formed in the lyophobic film. As a result, the nozzle plate 59 is produced that has the liquid droplet guiding portions 222 with lyophobic properties.

The above description is about the nozzle shape of the nozzle plate included in the liquid droplet discharging head according to the third embodiment and the manufacturing method of the nozzle plate. Now, a description will be given of a method for discharging a liquid droplet from the liquid droplet discharging head.

The liquid droplet L, which is discharged from the discharging outlet 221*c* after passing through the nozzle 221, is emitted along the liquid droplet guiding portion 222. The liquid droplet guiding portion 222 is formed on the first penetrating portion 221*a* with an inclination and has lyophobic properties. Thus, the liquid droplet L is easily discharged from the discharging outlet 221*c* along the lyophobic liquid droplet guiding portion 222. Accordingly, a rotational force can easily be applied to the liquid droplet L discharged from the discharging outlet 221*c* in a rotational direction. This facilitates the liquid droplet L to be directed toward the center of the nozzle 221. Then, since the liquid droplet L from the nozzle 221 flies relatively straight in the air, the liquid droplet L can land on a target position thereof more easily and accurately. Therefore, the liquid droplet discharging head 20 (See FIGS. 12A and 12B) allows improvement in the landing position accuracy of the liquid droplet L.

Consequently, the third embodiment provides the following advantageous effect in addition to those provided in the first and second embodiments:

9. Forming the liquid droplet guiding portion 222 using the photomask 91 allows a simple and efficient production thereof. Moreover, the shape of the pattern 222*a* of the photomask 91 can be freely changed, so that the liquid droplet guiding portions 222 can be formed in an arbitrary shape.

Fourth Embodiment

A fourth embodiment describes a liquid droplet discharging head that has loosely and densely distributed narrow grooves as liquid droplet guiding portions at a nozzle as a penetrating portion. The nozzle is formed in a nozzle plate as a second substrate.

Figure 8A:
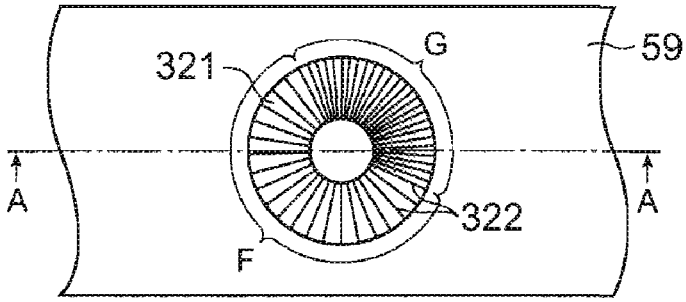
FIGS. 8A to 8C schematically show an example of a nozzle plate of a liquid droplet discharging head according to a fourth embodiment of the invention.
Figure 8B:
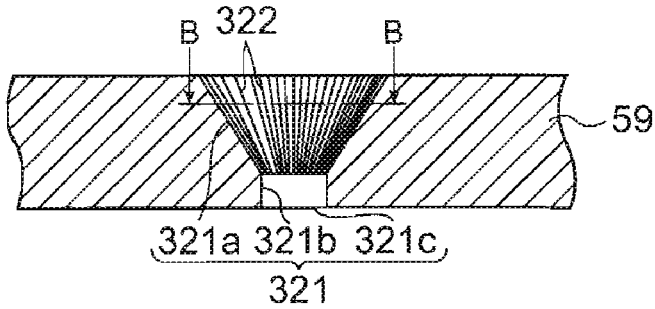
Figure 8C:
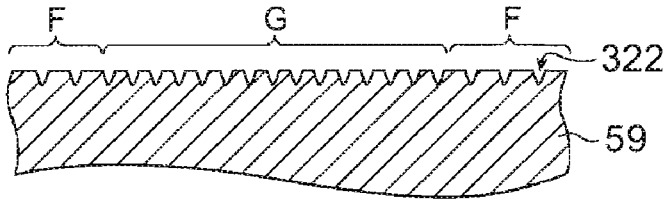
Figure 9A:
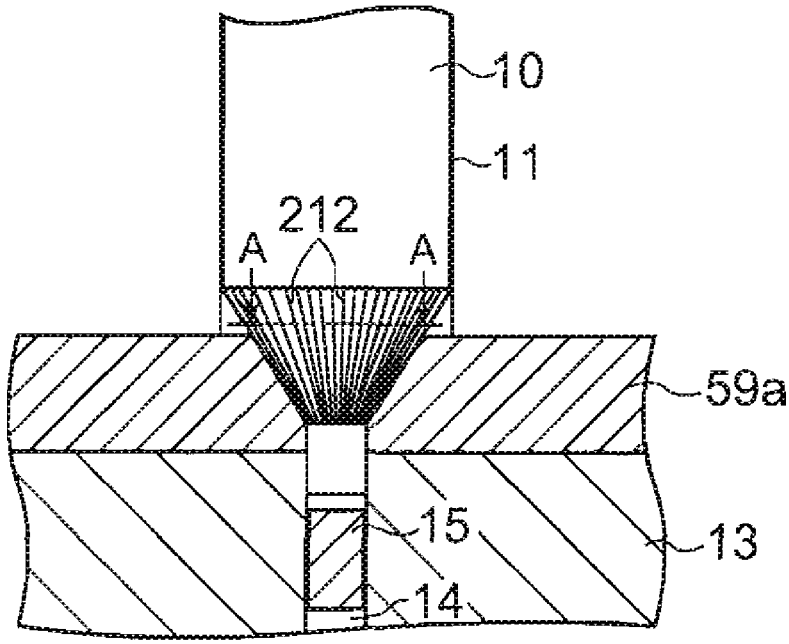
FIGS. 9A and 9B schematically illustrate a method for manufacturing the nozzle plate of the liquid droplet discharging head according to the fourth embodiment.
Figure 9B:
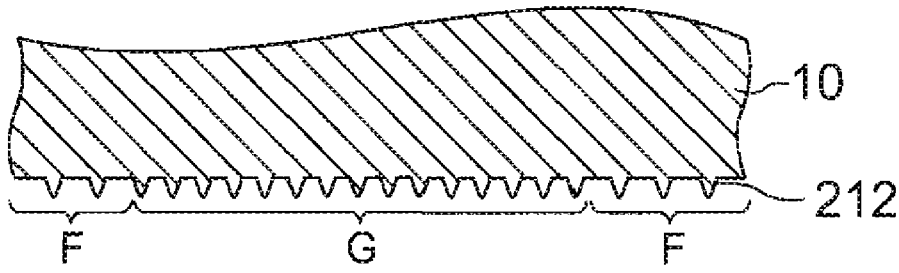

FIGS. 8A to 8C schematically show an example of the nozzle plate included in the liquid droplet discharging head according to the fourth embodiment. FIG. 8A is a plan view of the liquid droplet discharging head. FIG. 8B is a sectional view taken along a line A-A of FIG. 8A and FIG. 8C is a sectional view taken along a line B-B of FIG. 8B. FIGS. 9A and 9B illustrate a method for manufacturing the nozzle plate included in the liquid droplet discharging head. FIG. 9A is a schematic view of the nozzle plate and FIG. 9B is a sectional view taken along a line A-A of FIG. 9A. Referring to FIGS. 8A to 9B, a description will be given of the manufacturing method of the nozzle plate included in the liquid droplet discharging head according to the fourth embodiment and the manufacturing method thereof. Unlike the above-described first through third embodiments, the fourth embodiment employs liquid droplet guiding portions that are loosely and densely distributed. The same components as those used in the previous embodiments and components having the same functions as those provided therein are denoted by the same reference numerals and are not described below.

As shown in FIG. 8A, the nozzle plate 59 as the second substrate has a nozzle 321 as a penetrating portion formed therein. The nozzle plate 59 is one of components included in the liquid droplet discharging head 20 (See FIG. 12). The nozzle 321 has a plurality of liquid droplet guiding portions 322 that can guide the liquid droplet L (See FIG. 12). Additionally, each of the liquid droplet guiding portions 322 is arranged at an inclination with respect to a center of the nozzle 321 on a surface of a first penetrating portion 321*a* (See FIG. 8B). However, this is not the only option. The liquid droplet guiding portion 322 may be arranged, for example, in parallel with respect to the center thereof. As shown in the drawing, the liquid droplet guiding portions 322 are loosely and densely distributed on the surface of the first penetrating portion 321*a* (See FIG. 8B). Specifically, there are provided a dense part G where a large number of the liquid droplet guiding portions 322 are arranged and a loose part F where a smaller number of the liquid droplet guiding portions 322 is present than in the dense part G. The nozzle plate 59 is made of stainless steel.

As shown in FIG. 8B, the nozzle 321 as the penetrating portion in the nozzle plate 59 includes the first and second penetrating portions 321*a*, 321*b* and an discharging outlet 321*c*. The first penetrating portion 321*a* has a conical (mortar-like) shape, whereas the second penetrating portion 321*b* has a cylindrical shape. Each of the liquid droplet guiding portions 322 is formed continuously from the first penetrating portion 321*a* to the second penetrating portion 321*b*. In this embodiment, the liquid droplet guiding portion 322 formed on the first penetrating portion 321*a* is continued to the second penetrating portion 321*b*. However, as an alternative to this, the liquid droplet guiding portion 322 may be discontinued thereto. The first and second penetrating portions 321*a* and 321*b* are in communication with each other, thereby allowing the liquid droplet L (See FIG. 12B) to be discharged from the discharging outlet 321.*c*. Diameters of the first and second penetrating portions 321*a* and 321*b* are approximately 50 μm and 20 μm, respectively. The number of the nozzle 321 varies with applications of the liquid droplet discharging head 20 (See FIG. 12A). The nozzle plate 59 has a plurality of the nozzles 321 arranged therein.

In FIG. 8B, the liquid droplet guiding portions 322 extend from a top surface side (an upper side in the drawing) of the nozzle plate 59 toward a bottom surface side (a lower side therein) thereof. The liquid droplet guiding portions are arranged so as to be loosely and densely distributed. Additionally, the liquid droplet guiding portions 322 are narrow grooves which are formed on the surface the first penetrating portion 321*a*. As shown in the drawing, each of the liquid droplet guiding portions 322 extends in an discharging direction of the liquid droplet L. Furthermore, in accordance with a direction of the nozzle 321, considering such a layout balance between the loose and dense parts F and G of the liquid droplet guiding portions 322 allows correction in the discharging direction of the liquid droplet L. For example, if the nozzle 321 is formed not vertically but obliquely with respect to the top surface side (or the bottom surface side) of the nozzle plate 59, the liquid droplet L will be discharged obliquely along an oblique surface of the nozzle 321. Accordingly, the liquid droplet L cannot fly straight, which hinders its accurate landing on a target position. The number of the nozzles 321 included in the liquid droplet discharging head 20 (See FIG. 12A) varies with applications thereof. The nozzle plate 59 has the plurality of nozzles 321 arranged therein. That is, the nozzles 321 included in the liquid droplet discharging head 20 may vary depending on a processing accuracy thereof, and the nozzle direction may vary.

As shown in FIG. 8C, the liquid droplet guiding portions 322 are arranged so as to form both the loose part F and the dense part G. In the dense part G having the densely distributed liquid droplet guiding portions 322, a distribution density of the liquid droplet guiding portions 322 is approximately twice that in the loose part F.

In FIG. 8C, each of the liquid droplet guiding portions 322 has a roughly triangular sectional shape and is formed as a recessed groove. Each of the recessed grooves is narrow and is approximately 1 μm in width and depth. However, the shape thereof is not limited to be the triangular one and may be a polygonal shape such as a square or pentagonal shape. Additionally, although the sectional shapes of the liquid droplet guiding portions 322 are the recessed grooves, they may be protruded portions, for example. Furthermore, like the recessed grooves, sectional shapes of the protruded portions are not limited to the triangular ones. They may be polygonal such as square or pentagonal.

Next, a description will be given of a method for manufacturing the liquid droplet guiding portions 322.

As shown in FIG. 9A, in the manufacturing method according to the fourth embodiment, for example, a die structure may be used. The die structure roughly includes the punch 10, the stripper plate 11, the die plate 13 and the hole 14 formed in the die plate 13. A protruded portion 212 corresponding to each liquid droplet guiding portion 322 (FIGS. 8B and 8C) is linearly (See FIG. 8A) formed at the conical portion of the punch 10. The punch 10 has a shape matching with the nozzle 321 (FIGS. 8A and 8B). Additionally, the hole 14 in the die plate 13 is formed so as to be slightly larger than the tip diameter of the punch 10.

The nozzle plate material 59*a* is arranged on the die plate 13. The punch 10 is abutted against the nozzle plate material 59*a* to penetrate therethrough. This produces the punched-out slug 15, which falls in the hole 14. As a result, the nozzle 321 as the penetrating portion can be formed that has the first and second penetrating portions 321*a* and 321*b*. Simultaneously, abutment of the protruded portion 212 against the nozzle plate material 59*a* allows a formation of the liquid droplet guiding portion 322 (See FIG. 8A) in the first penetrating portion 321*a*. Furthermore, forming the protruded portion 212 at the conical part of the punch 10 allows the formation of the liquid droplet guiding portion 322 (See FIG. 8A). Consequently, the nozzle plate 59 can be formed that includes the liquid droplet guiding portion 322 (See FIG. 8B) in the first penetrating portion 321*a* (FIG. 8B). The protruded portion 212 formed at the conical part of the punch 10 includes a plurality of the protruded portions 212. The number of the protruded portions 212 corresponds to that of the liquid droplet guiding portions 322 (See FIG. 8A).

As shown in FIG. 9B, the protruded portions 212 corresponding to the liquid droplet guiding portions 322 are arranged so as to form the loose part F and the dense part G. In the dense part G, a distribution density of the protruded portions 212 is approximately twice that in the loose part F.

In FIG. 9B, each of the protruded portions 212 has a roughly triangular sectional shape which corresponds to that of each of liquid droplet guiding portions 322 formed as the recessed grooves.

The above description is about the nozzle shape of the nozzle plate included in the liquid droplet discharging head according to the fourth embodiment and the manufacturing method thereof. Described next will be a method for discharging a liquid droplet from the liquid droplet discharging head.

The liquid droplet L, which is discharged from the discharging outlet 321*c* after passing through the nozzle 321, is emitted along the liquid droplet guiding portion 322. The liquid droplet guiding portion 322, which is formed on the first penetrating portion 321*a* having the conical (mortar-like) shape, is a narrow groove. Thus, the liquid droplet L is easily discharged from the discharging outlet 321*c* along the narrow groove. The directions of the nozzles 321 arranged on the nozzle plate 59 may vary. Thus, in order to correspond to the direction of each of the nozzles 321, the liquid droplet guiding portions 322 are loosely and densely distributed so as to form the loose part F and the dense part G on each nozzle 321. Then, in the loose part F where the liquid droplet guiding portions 322 are loosely distributed, a resistance applied to the liquid droplet L is weaker than in the dense part G where they are densely distributed. This facilitates the liquid droplet L to be quickly discharged from the discharging outlet 321*c* in the nozzle 321. In other words, considering a layout balance between the loose part F and the dense part G allows correction of the direction of the liquid droplet L discharged from each nozzle 321. The correction thereof allows the liquid droplet L to land on a target position thereof, thereby enabling improvement in the landing position accuracy of the liquid droplet L. Therefore, the liquid droplet discharging head 20 (See FIG. 12A) allows improvement in the landing position accuracy thereof.

Consequently, the fourth embodiment provides the following advantageous effects.

10. The liquid droplet guiding portions 322 are formed on the surface of the first penetrating portion 321*a* of the nozzle 321 as the penetrating portion. Additionally, they are both loosely and densely distributed, extending in the discharging direction of the liquid droplet L. This allows a subtle correction of the discharging direction thereof. Even if the directions of the nozzles 321 of the nozzle plate 59 vary, the liquid droplet L can land on a target position thereof more easily and accurately, because the variation in the discharging direction thereof can be corrected.

11. The liquid droplet guiding portions 322 are the grooves which are both loosely and densely distributed in parallel with or at an inclination with respect to the discharging direction of the liquid droplet L. This applies a resistance to the discharged liquid droplet L in a particular direction, whereby the discharging direction thereof can be subtly corrected. Even if there is a variation among the directions of the plurality of the nozzles 321 arranged at the nozzle plate 59, the discharging direction of the liquid droplet L is corrected in accordance with the direction of each of the nozzles 321 to adjust a flying direction thereof. As a result, it is easier for even a miniaturized liquid droplet L to land on a target position thereof accurately.

12. The first penetrating portion 321*a* has a conical shape. Accordingly, forming the liquid droplet guiding portions 322 on the surface thereof can make it easier to guide the liquid droplet L.

Fifth Embodiment

A fifth embodiment of the invention describes a liquid droplet discharging head including a nozzle plate with nozzles where there are formed patterns having different wettabilities. The patterns having different wettabilities are included in a first penetrating portion.

Figure 10A:
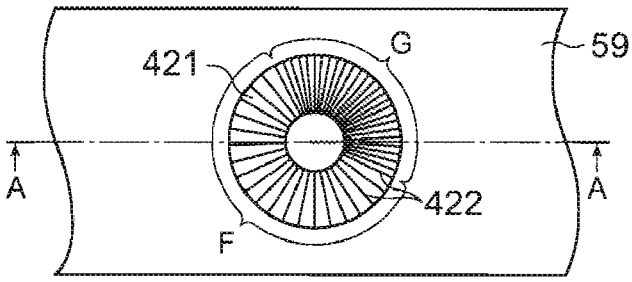
FIGS. 10A and 10B schematically show an example of a nozzle plate of a liquid droplet discharging head according to a fifth embodiment of the invention.
Figure 10B:
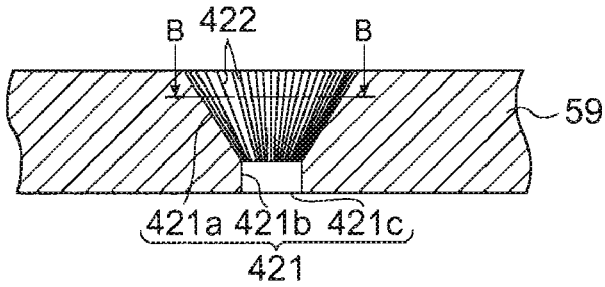
Figure 11A:
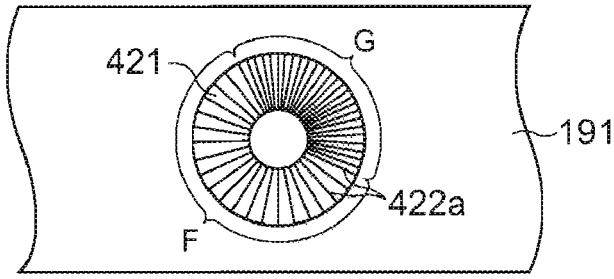
FIG. 11A and FIG. 11B illustrate a method for manufacturing the nozzle plate of liquid droplet discharging head according to the fifth embodiment.
Figure 11B:
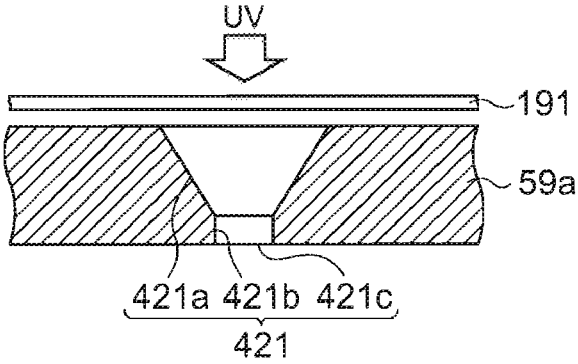

FIGS. 10A and 10B schematically show an example of the nozzle plate included in the liquid droplet discharging head according to the fifth embodiment. FIG. 10A is a plan view of the nozzle plate and FIG. 10B is a sectional view thereof taken along a line A-A of FIG. 10A. FIGS. 11A and 11B illustrate a method for manufacturing the nozzle plate in the liquid droplet discharging head. FIG. 11A is a schematic view of a photomask. FIG. 11B shows a state in which the photomask is placed on the nozzle plate material. The processings of the nozzle plate included in the liquid droplet discharging head are the same as those of the flowchart shown in FIG. 7 and will not be described below. Referring to FIGS. 10A to 11B and FIG. 7, a description will be given of the nozzle plate of the liquid droplet discharging head according to the fifth embodiment and the manufacturing method thereof. Unlike the first through fourth embodiments, the present embodiment employs liquid droplet guiding portions that are formed as patterns having different wettabilities and are loosely and densely distributed. The same components as those in the previous embodiments and components having the same functions as those therein are denoted by the same reference numerals and will not be described below.

As shown in FIG. 10A, the nozzle plate 59 as the second substrate has a nozzle 421 as a penetrating portion formed therein. The nozzle 421 has a plurality of liquid droplet guiding portions 422 that can guide the liquid droplet L. In the drawing, each of the liquid droplet guiding portions 422 on a surface of a first penetrating portion 421*a* (See FIG. 10B) is linearly arranged. The liquid droplet guiding portion 422 is a region having a low wettability with respect to the liquid droplet L and exhibits high lyophobic properties. The remaining part where the liquid droplet guiding portions 422 are not formed is a region having a high wettability with respect thereto and exhibits high lyophilic properties.

As shown in FIG. 10B, the liquid droplet guiding portions 422 are formed on a surface of the first penetrating portion 421*a*. The liquid droplet guiding portions 422 are formed continuously from the first penetrating portion 421*a* to a second penetrating portion 421*b*.

In FIG. 10B, the liquid droplet guiding portions 422 extend from a top surface side (an upper side in the drawing) of the nozzle plate 59 toward a bottom surface side (a lower side therein) thereof to be arranged linearly. The liquid droplet guiding portions 422 are lyophobic patterns. As shown in the drawing, the liquid droplet guiding portions 422 extend in the discharging direction of the liquid droplet L.

Described next will be the manufacturing method of the liquid droplet guiding portions.

FIG. 11A shows a photomask 191. As shown in the drawing, the photomask 191 has a pattern 422*a* for forming each of the liquid droplet guiding portions 422 on the nozzle 421 of the nozzle plate 59.

As shown in FIG. 11B, after the photomask 191 is placed on the nozzle plate material 59*a* having the nozzle 421, UV light is irradiated from an upper surface side (an upper side in the drawing) of the photomask 191. This allows a formation of both lyophobic and lyophilic regions on a surface of the first penetrating portion 421*a*. Additionally, the liquid droplet guiding portion 422 can be formed having lyophobic properties.

The above description is about the nozzle shape of the nozzle plate included in the liquid droplet discharging head according to the fifth embodiment and the manufacturing method thereof. Now, a description will be given of a method discharging a liquid droplet from the liquid droplet discharging head.

The liquid droplet L, which is discharged from an discharging outlet 421*c* after passing through the nozzle 421, is emitted along each of the liquid droplet guiding portions 422. The liquid droplet guiding portion 422 is formed on the first penetrating portion 421*a* having a conical (mortar-like) shape and is a groove having lyophobic properties. Thus, the liquid droplet L is easily discharged from the discharging outlet 421*c* along each of the lyophobic grooves. There may be a variation among directions of the nozzles 421 arranged at the nozzle plate 59. Thus, in order to correspond to the direction of each of the nozzles 421, the liquid droplet guiding portions 422 are both loosely and densely arranged so as to form the loose part F and the dense part G on each nozzle 422. This allows correction in the discharging direction of the liquid droplet L for each of the nozzles 421. More specifically, it is easier for the liquid droplet L1 to pass through the loose part F than through the dense part G. Accordingly, a flying direction of the liquid droplet L, which is discharged from the discharging outlet 421*c*, can easily be corrected in accordance with the direction of each of the nozzles 421. The correction of the flying direction thereof allows the liquid droplet L to fly straight to a target position thereof, thereby improving the landing position accuracy of the liquid droplet L. Therefore, the liquid droplet discharging head 20 (See FIG. 12A) allows improvement in the landing position accuracy thereof.

The fifth embodiment provides the following advantageous effect.

13. The liquid droplet guiding portions 422 are formed using the photomask 191. Thus, an irradiation of UV light onto the surface of the first penetrating portion 421*a* is only necessary to form the guiding portions 422. This allows a simple and efficient production thereof. Moreover, since the shapes of the patterns 422*a* of the photomask 191 can be freely changed, the liquid droplet guiding portions 422 can be formed in an arbitrary shape.

Described next will be a manufacturing method of the liquid droplet discharging head according to the fifth embodiment and a liquid droplet discharging apparatus discharging (dropping) a liquid droplet from the liquid droplet discharging head. However, first, a description will be given as to a material of a film pattern formed by a liquid droplet discharging technique, an discharging technique and hardening treatment for film material, sequentially. Thereafter, there will be described about the manufacturing method thereof and a characteristic structure of the discharging apparatus, Film Material A film material used for forming a film pattern by a liquid droplet discharging technique is composed of dispersion liquid obtained by dispersing conductive microparticles into a dispersing medium. As the conductive microparticles, the fifth embodiment employs, for example, metallic particles containing one of gold, silver, copper, iron, chromium, manganese, molybdenum, titanium, palladium, tungsten and nickel, microparticles of an oxide of any thereof, microparticles of a conductive polymer, a superconductive material or the like. It is also possible to coat surfaces of the conductive microparticles with an organic material or the like in order to improve dispersibility thereof. A grain diameter of each of the conductive microparticles preferably ranges from 1 nm to 0.1 μm. If the diameter thereof is greater than 0.1 μm, the nozzle 21 (nozzle 121, 221, 321 or 421) of the liquid droplet discharging head 20, which will be described below, can be clogged. Furthermore, if the grain diameter thereof is smaller than 1 nm, a volume ratio of a coating agent to the conductive microparticles increases, resulting in an excessive increase in a ratio of an organic material in an obtained film.

The dispersing medium is not specifically limited as long as it can disperse the above-mentioned conductive microparticles and causes no aggregation. Examples of the dispersing medium include water, alcohols such as methanol, ethanol, propanol and butanol, hydrocarbon compounds such as n-heptane, n-octane, decane, dodecane, tetradecane, toluene, xylene, cymene, durren, indene, dipentene, tetrahydronaphthalene, decahydronaphthalene and cyclohexylbenzene, ether compounds such as ethyleneglycoldimethylether, ethyleneglycoldiethylether, ethyleneglycolmethylethylether, diethyleneglycoldimethylether, diethyleneglycoldiethylether, diethyleneglycolmethylethylether, 1,2-dimethoxyethane, bis(2-methoxyethyl) ether and p-dioxane, and polar compounds such as propylenecarbonate, .gamma.-butyrolactone, N-methyl-2-pyrrolidone, dimethylformamide, dimethylsulfoxide and cyclohexanone. Among them, it is preferable to use water, alcohols, hydrocarbon compounds and ether compounds because of the dispersibility of conductive microparticles, the stability of dispersion liquid and easy applicability to the liquid droplet discharging technique. More preferable dispersion media may be water and hydrocarbon compounds.

A surface tension of the dispersion liquid of the conductive microparticles preferably ranges from 0.02 N/m to 0.07 N/m. When the liquid droplet L is discharged by the liquid droplet discharging technique, if the surface tension thereof is less than 0.02 N/m, a wettability of a functional liquid component with respect to a nozzle surface increases, which tends to cause a flight diversion of a liquid droplet. If the surface tension is greater than 0.07 N/m, a meniscus shape at a nozzle tip becomes unstable. This hinders a control of the amount and timing of discharging. In order to adjust the surface tension, a very small amount of a surface tension regulator, such as a fluorine-based, silicon-based or nonionic-based agent, may be added to the above dispersion liquid in a range of not significantly reducing a contact angle with a substrate. The nonionic surface tension regulator can increase liquid wettability with respect to the substrate and can improve leveling properties of a film, thereby serving to prevent minute unevenness in the film. The above-mentioned surface tension regulator may contain an organic compound such as alcohol, ether, ester or ketone, when necessary.

A viscosity of the dispersion liquid is preferably in a range from 1 mPas to 50 mPas. When a liquid material as the liquid droplet L is discharged through a liquid droplet discharging technique, if the viscosity thereof is smaller than 1 mPas, a peripheral region of the nozzle can be contaminated due to an outflow of functional liquid. If the viscosity thereof is greater than 50 mPas, clogging frequency of the nozzle increases, which hinders smooth discharging.

Liquid Droplet Discharging Technique

Among various techniques for discharging liquid droplets, an inkjet technique is preferably used, because it allows a formation of minute patterns on demand. Examples of such an inkjet technique include a charge control system, a pressurization/vibration system, an electromechanical transducing system, an electrothermal transducing system and an electrostatic absorbing system. In the charge control system, electric charge is applied to a material by a charging electrode and then a flying direction of the material is controlled by a deflecting electrode, whereby the material is discharged from a nozzle. In the pressurization/vibration system, an ultrahigh pressure of approximately 30 kg/cm$^2$ is applied to a material to discharge the material onto a nozzle tip side. In this system, when applying no control voltage, the material proceeds to be discharged from the nozzle. Whereas a control voltage is applied thereto, an electrostatic repulsive interaction occurs between material particles. Accordingly, the material is dispersed and is not discharged. The electromechanical transducing system uses the properties of a piezoelectric element that deforms in response to application of a pulsed electrical signal. Due to the deformation of the piezoelectric element, a pressure is applied to a material-storing space via a flexible substance, so that the material is pushed out from the space to be discharged from the nozzle.

Additionally, the electromechanical transducing system produces bubbles by rapidly evaporating the material using a heater provided in the material-storing space, where a pressure of the bubbles allows discharging of the material stored in the space. The electrostatic attraction system applies a minute pressure into the material-storing space to form a meniscus of material in the nozzle. In this state, electrostatic attraction is applied to discharge the material. Besides them, it is also possible to use a system using a viscosity change in fluids caused due to an electric field, a system discharging material by spark energy of discharge. The liquid droplet discharging technique has advantages in which there is little waste in the use of material and also a desired amount of material can be landed on a desired position accurately. The amount of a single droplet of liquid material discharged by the liquid droplet discharging technique ranges from 1 to 300 nanogram, for example.

Hardening Treatment of Film Material

The hardening treatment of film material is also referred to as firing treatment and is usually performed in an air atmosphere. However, if needed, the treatment can be performed in an inert gas atmosphere such as nitrogen, argon or helium, or in a reducing atmosphere such as hydrogen. A temperature for firing treatment is appropriately determined in consideration of a boiling point (vapor pressure) of a dispersion medium, the kind and pressure of an atmospheric gas, the thermal behaviors of microparticles including dispersibility and oxidizability, the presence or absence of a coating agent and the amount thereof, the heat resistance of a base material and the like. In the fifth embodiment, a firing treatment was performed for the film material at 200 degrees centigrade for approximately 60 minutes in a clean oven in an air atmosphere. The treatment as described above allows a formation of a film layer (not shown), thereby ensuring an electrical contact between microparticles.

Such firing treatment can also be performed using an ordinary hot plate, an electric furnace or the like, or by lamp annealing. A source of light used for lamp annealing is not specifically limited. For example, the light source may be an infrared lamp, a xenon lamp, a YAG laser, an argon laser, a carbon dioxide gas laser, an excimer laser such as XeF, XeCl, XeBr, KrF, KrCl, ArF or ArCl. These light sources generally have an output range of 10 W to 5,000 W. However, a range of 100 W to 1,000 W is enough for the fifth embodiment.

Then, a desirable film pattern can be formed by placing a film material using the liquid droplet discharging technique and then hardening the material.

Next, a brief description will be given of the manufacturing method of the liquid droplet discharging head according to the fifth embodiment by referring to FIGS. 12A and 12B.

A partition member 62 is formed as a first substrate. Next, the nozzle plate 59 as the second substrate is formed that includes the liquid droplet guiding portions 22 (122, 222, 322 or 422). Then, a vibration plate 61 is formed as a third substrate. Finally, the partition member 62, the nozzle plate 59 and the vibration plate 61 are bonded to each other to form the liquid droplet discharging head 20.

The liquid droplet discharging head 20, as described in the above first through fifth embodiments, has the structure in which the liquid droplet guiding portions 22 (122, 222, 322 or 422) are formed at the nozzles 21 (121, 221, 321 or 421). The structure allows the formation of the liquid droplet discharging head 20 that allows improvement in the landing position accuracy of the liquid droplets L.

Next, a description will be given of a structure of the liquid droplet discharging apparatus according to the fifth embodiment.

Figure 13:
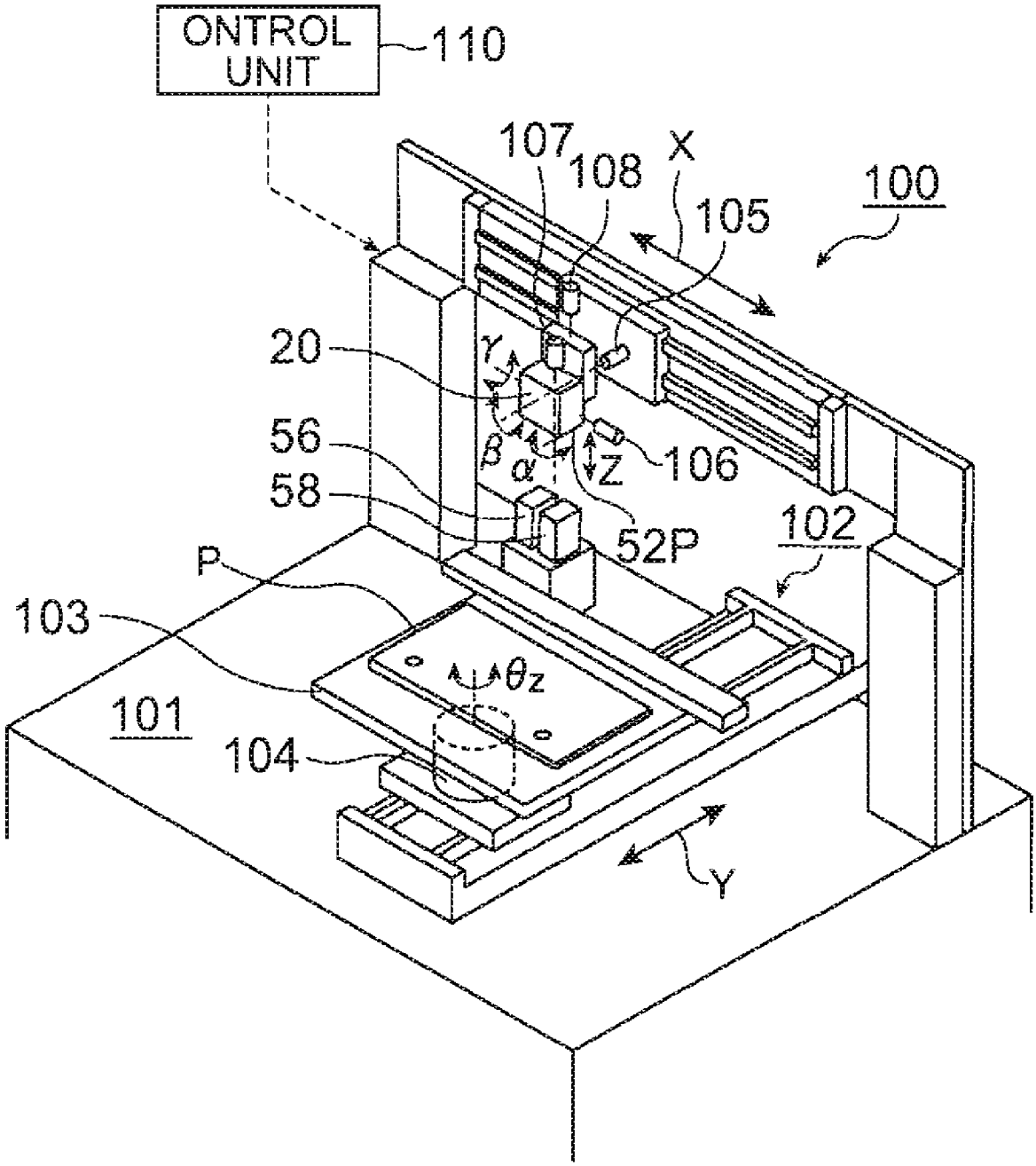
FIG. 13 is a perspective view illustrating a schematic structure of a liquid droplet discharging apparatus according to the above embodiments of the invention.

FIG. 13 is a perspective view of a liquid droplet discharging apparatus 100. In FIG. 13, an X direction represents a right and left direction of a base 101, a Y direction represents a back and forth direction thereof, and a Z direction represents an upper and lower direction thereof. The liquid droplet discharging apparatus 100 mainly includes the liquid droplet discharging head 20, a base P and a table 103 with the base P thereon. A control unit 110 controls performance of the liquid droplet discharging apparatus 100.

The table 103 with the base P thereon can be moved and position-determined in the Y direction by a first moving unit 102. Additionally, the table 103 can be oscillated and position-determined in a theta z direction by a motor 104. Meanwhile, the liquid droplet discharging head 20 can be moved and position, determined in the X direction by a second moving unit, as well as can be moved and position-determined in the Z direction by a linear motor 108. Furthermore, the liquid droplet discharging head 20 can be oscillated and position-determined in alpha, beta and gamma directions, respectively, by motors 105, 106 and 107, respectively. Accordingly, the liquid droplet discharging apparatus 100 can accurately control relative positions and postures between an ink discharging surface 52P of the liquid droplet discharging head 20 and the substrate P on the table 103.

A capping unit 56 shown in FIG. 13 is configured to cap the discharging surface 52P at a standby time of the liquid droplet discharging apparatus 100 in order to prevent dryness of the discharging surface 59P included in the liquid droplet discharging head 20. In addition, a cleaning unit 58 vacuums the inside of nozzles to remove clogging thereof in the liquid droplet discharging head 20. Furthermore, the cleaning unit 58 can also perform wiping of the discharging surface 52P to remove contamination of the discharging surface 52P in the liquid droplet discharging head 20.

The liquid droplet discharging apparatus 100 according to the fifth embodiment includes the liquid droplet discharging head 20 that allows improvement in the landing position accuracy of the liquid droplets L. Thus, even if the size of the liquid droplet L is miniaturized, high-quality drawings can be produced. For example, as a printing apparatus or the like, such as an inkjet printer using ink as the liquid droplet L, the invention can provide a printing apparatus that allows improvement in printing quality.

The preferable exemplary embodiments of the invention have been described above. However, the invention is not limited to those embodiments above and includes modifications as below. The invention can employ concrete structures and configurations of any other embodiment or modification within a range of attaining advantages of the invention.

First Modification

The liquid droplet discharging head 20 according to the above first through third embodiments includes the liquid droplet guiding portions 22 (122 or 222) provided on the surface of the nozzles 21 (121 or 221) as the penetrating portions. However, this is not the only option. For example, as shown in FIGS. 14A, 14B and 14C, a liquid droplet guiding portion 522 may be formed at a first penetrating portion 521*a* and a protruded portion 522*a* may be formed on the surface of the nozzle plate 59 as the second substrate. This arrangement can also provide the same advantageous effects as those obtained in the first through third embodiments, thereby stabilizing straight flight properties of the liquid droplet L. Therefore, the liquid droplet discharging head 20 allows improvement in the landing position accuracy of the liquid droplet L.

Second Modification

The liquid droplet discharging head 20 according to the above first through third embodiments has the liquid droplet guiding portions 22 (122 or 222) arranged on the surface of the nozzles 21 (121 or 221) as the penetrating portions. However, the arrangement is not limited to this. For example, as shown in FIGS. 15A, 15B and 15C, a liquid droplet guiding portion 622 may be formed on a second penetrating portion 621*b* and a protruded portion 622*a* may be formed on the nozzle plate 59 as the second substrate. This arrangement can also provide the same advantageous effects as those obtained in the first through third embodiments, thereby stabilizing the straight flight properties of the liquid droplet L. Therefore, the liquid droplet discharging head 20 allows improvement in the landing position accuracy of the liquid droplet L.

Third Modification

Figure 16A:
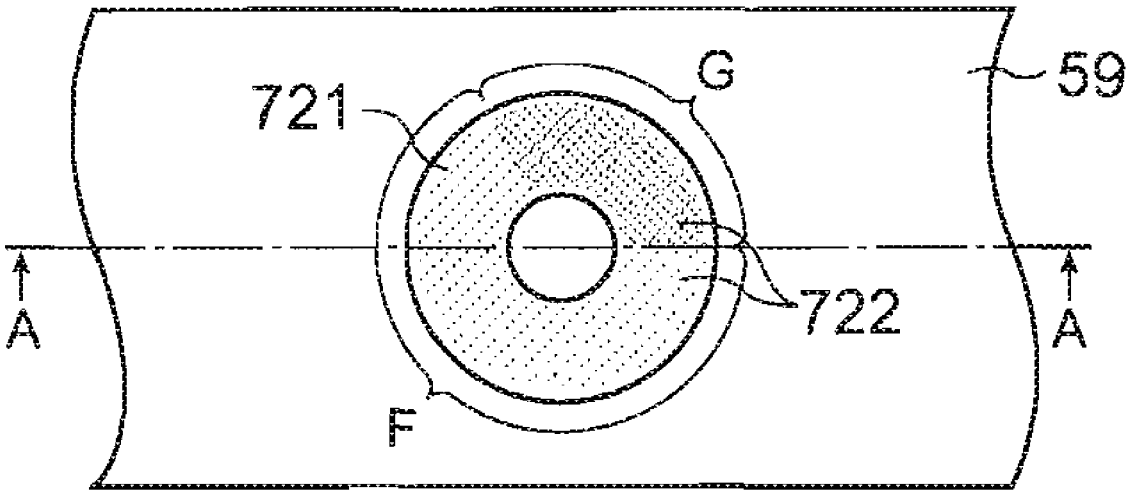
FIGS. 16A and 16B schematically show an example of a nozzle plate of a liquid droplet discharging head according to a third modification.
Figure 16B:
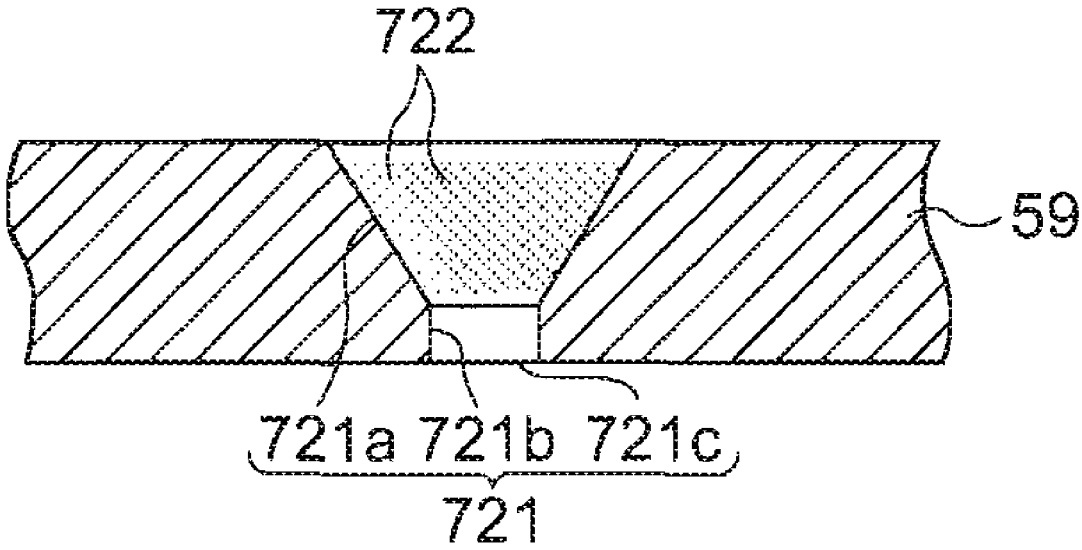

The liquid droplet discharging head 20 according to the above fourth and fifth embodiments has the liquid droplet guiding portions 322 (422) that are loosely and densely distributed on the surface of the first penetrating portion 321*a* (421*a*). However, the arrangement is not limited to this. For example, as shown in FIGS. 16A and 16B, liquid droplet guiding portions 722 as recessed and protruded portions may be loosely and densely distributed on a surface of a first penetrating portion 721*a*. This arrangement can also provide the same advantageous effects as those obtained in the fourth and fifth embodiments. Therefore, the liquid droplet discharging head 20 allows improvement in the landing position accuracy of the liquid droplet L.

Fourth Modification

The liquid droplet discharging head 20 according to the above fourth and fifth embodiments and the third modification has the liquid droplet guiding portions 322 (422) that are loosely and densely distributed on the surface of the first penetrating portion 321*a* (421*a*). However, the arrangement is not limited to this. For example, only the dense part G may be arranged at a part of the first penetrating portion 321*a* (421*a*). This arrangement can also provide the same advantageous effects as those obtained in the fourth and fifth embodiments and the third modification. Therefore, the liquid droplet discharging head 20 allows improvement in the landing position accuracy of the liquid droplet L.

Fifth Modification

The liquid droplet discharging head 20 according to the above fourth and fifth embodiments and the third modification has the liquid droplet guiding portions 322 (422) that are loosely and densely distributed on the surface of the first penetrating portion 321*a* (421*a*). However, the arrangement is not limited to this. For example, only the loose part F may be arranged at a part of the surface of the first penetrating portion 321*a* (421*a*). This arrangement can also provide the same advantageous effects as those obtained in the fourth and fifth embodiments and the third modification. Therefore, the liquid droplet discharging head 20 allows improvement in the landing position accuracy of the liquid droplet L.

Sixth Modification

The liquid droplet discharging head 20 according to the above fourth and fifth embodiments and the third modification has the liquid droplet guiding portions 322 (422 or 722) that are loosely and densely distributed on the surface of the first penetrating portion 321*a* (421*a* or 721*a*). However, the arrangement is not limited to this. For example, the liquid droplet guiding portions 322 (422 or 722) may be arranged on surfaces of both the first penetrating portion 321*a* (421*a* or 721*a*) and the second penetrating portion 321*b* (421*b* or 721*b*). This arrangement can also provide the same advantageous effects as those obtained in the fourth and fifth embodiments and the third modification. Therefore, the liquid droplet discharging head 20 allows improvement in the landing position accuracy of the liquid droplet L.

Seventh Modification

The liquid droplet discharging head 20 according to the above fourth and fifth embodiments and the third modification has the liquid droplet guiding portions 322 (422 or 722) that are loosely and densely distributed on the surface of the first penetrating portion 321*a* (421*a* or 721*a*). However, the arrangement is not limited to this. For example, the liquid droplet guiding portions 322 (422 or 722) may be arranged on the surface of the second penetrating portion 321*b* (421*b* or 721*b*). This arrangement can also provide the same advantageous effects as those obtained in the fourth and fifth embodiments and the third modification. Therefore, the liquid droplet discharging head 20 allows improvement in the landing position accuracy of the liquid droplet L.

The entire disclosure of Japanese Patent Application Nos: 2006-068830, filed Mar. 14, 2006, 2006-262308, filed Sep. 27, 2006, and 2006-070682, filed Mar. 15, 2006 are expressly incorporated by reference herein.

What is claimed is:

1. A liquid droplet discharging head, comprising:

a pressure chamber;

a first penetrating portion formed in a substrate and connected to the pressure chamber, the first penetrating portion having a plurality of liquid droplet guiding portions, each of which extending with a curvature in a discharging direction of the liquid droplet; and a second penetrating portion formed continuously from the first penetrating portion in the substrate.

2. The liquid droplet discharging head according to claim 1, the first penetrating portion being formed in a conical shape.

3. The liquid droplet discharging head according to claim 1, the plurality of liquid droplet guiding portions being formed in a spiral manner in plane view.

4. The liquid droplet discharging head according to claim 1, the each of the plurality of liquid droplet guiding portions having a first line and a second line in cutaway view, the first line including a round portion.

5. The liquid droplet discharging head according to claim 1, the each of the plurality of liquid droplet guiding portions having a first line and a second line in cutaway view, the first line being longer than the second line.

6. The liquid droplet discharging head according to claim 1, the each of the plurality of liquid droplet guiding portions having a first line and a second line in cutaway view, the first line and the second line forming a pointed end portion, the first and second lines being positioned at an approximately equal distance from the pointed end portion.

7. The liquid droplet discharging head according to claim 1, the each of the plurality of liquid droplet guiding portions having a first line and a second line in cutaway view, the first line and the second line forming a pointed end portion, the first and second lines being positioned symmetrically with respect to the pointed end portion.

8. The liquid droplet discharging head according to claim 1, the each of the plurality of liquid droplet guiding portions having a first line and a second line in cutaway view, the first line and the second line forming a pointed end portion, the pointed end portion forming a protruded portion of the second penetrating portion in cutaway view.

9. The liquid droplet discharging head according to claim 1, the each of the plurality of liquid droplet guiding portions having a first line and a second line in cutaway view, the first line and the second line forming a pointed end portion, the pointed end portion forming a recessed portion of the second penetrating portion in cutaway view.

10. The liquid droplet discharging head according to claim 1, an extending direction of each of the plurality of liquid droplet guiding portions being in parallel with respect to the discharging direction of the liquid droplet.

11. The liquid droplet discharging head according to claim 1, the each of the plurality of liquid droplet guiding portions being equally spaced.

12. The liquid droplet discharging head according to claim 1, the each of the plurality of liquid droplet guiding portions being unequally spaced.

13. The liquid droplet discharging head according to claim 1, a first group of the plurality of liquid droplet guiding portions being distributed in a first area of the first penetrating portion, a second group of the plurality of liquid droplet guiding portions being distributed in a second area of the first penetrating portion, a first distribution density of the first group of the plurality of liquid droplet guiding portions being loosely distributed with respect to a second distribution density of the second group of the plurality of liquid droplet guiding portions.

14. The liquid droplet discharging head according to claim 1, the each of the plurality of liquid droplet guiding portions having a protruding portion that is protruded from the second penetrating portion toward the pressure chamber.

15. A liquid droplet discharging apparatus, comprising the liquid droplet discharging head according to claim 1.

16. The liquid droplet discharging head according to claim 1, the second penetrating portion being formed in a cylindrical shape.

17. A liquid droplet discharging head, comprising:

a pressure chamber; and a penetrating portion formed in a substrate and connected to the pressure chamber, the penetrating portion having a plurality of liquid droplet guiding portions, each of which extending in a discharging direction of the liquid droplet, and having a first line and a second line in cutaway view, the first line including a round portion.

18. A liquid droplet discharging head, comprising:

a pressure chamber;

a first penetrating portion formed in a substrate and connected to the pressure chamber, the first penetrating portion having a plurality of liquid droplet guiding portions, where a first group of the plurality of liquid droplet guiding portions being distributed in a first area of the first penetrating portion, a second group of the plurality of liquid droplet guiding portions being distributed in a second area of the first penetrating portion, and a distribution density of the first group of the plurality of liquid droplet guiding portions being looser than a distribution density of the second group of the plurality of liquid droplet guiding portions; and a second penetrating portion formed in the substrate and connected to the first penetrating portion.

* * * * *